US010765573B2

(12) United States Patent
You

(10) Patent No.: US 10,765,573 B2
(45) Date of Patent: Sep. 8, 2020

(54) WHEELCHAIR BRAKE SYSTEM

(71) Applicant: Young Bae You, Seoul (KR)

(72) Inventor: Young Bae You, Seoul (KR)

( * ) Notice: Subject to any disclaimer, the term of this patent is extended or adjusted under 35 U.S.C. 154(b) by 345 days.

(21) Appl. No.: 15/526,329

(22) PCT Filed: Nov. 20, 2015

(86) PCT No.: PCT/KR2015/012553
§ 371 (c)(1),
(2) Date: May 11, 2017

(87) PCT Pub. No.: WO2016/080807
PCT Pub. Date: May 26, 2016

(65) Prior Publication Data

US 2017/0312152 A1 Nov. 2, 2017

(30) Foreign Application Priority Data

Nov. 20, 2014 (KR) ..... 10-2014-0162755
Dec. 5, 2014 (KR) ..... 10-2014-0174131
Feb. 6, 2015 (KR) ..... 10-2015-0018616

(51) Int. Cl.
*A61G 5/10* (2006.01)
*A61G 5/08* (2006.01)
*A61G 5/12* (2006.01)

(52) U.S. Cl.
CPC ..... *A61G 5/101* (2013.01); *A61G 5/08* (2013.01); *A61G 5/0816* (2016.11); *A61G 5/10* (2013.01); *A61G 5/1008* (2013.01); *A61G 5/1018* (2013.01); *A61G 5/1024* (2013.01); *A61G 5/1035* (2013.01); *A61G 5/128* (2016.11); *A61G 5/125* (2016.11); *A61G 2203/30* (2013.01); *A61G 2203/34* (2013.01)

(58) Field of Classification Search
CPC ..... B62K 11/007; B62K 11/14; B62K 13/00; B62K 7/00
See application file for complete search history.

(56) References Cited

U.S. PATENT DOCUMENTS 5,203,433 A * 4/1993 Dugas ..... A61G 5/1027 188/109
2004/0051272 A1* 3/2004 Wong ..... A61G 5/023 280/244

(Continued)

FOREIGN PATENT DOCUMENTS

JP 2004-016406 * 1/2001
JP 2003-153961 A 5/2003

(Continued)

OTHER PUBLICATIONS

International Search Report for PCT/KR2015/012553 dated Mar. 11, 2016 from Korean Intellectual Property Office.

*Primary Examiner* — Tony H Winner
(74) *Attorney, Agent, or Firm* — Revolution IP, PLLC

(57) ABSTRACT

A wheelchair brake system comprises: a brake which is provided in a wheel of a wheelchair; and a brake actuation controller which connects with the brake and locks and releases the brake, wherein the brake is usually in a lock mode, but the brake actuation controller controls the brake to be switched over from the lock mode to a release mode if sensing that a user sits down on the wheelchair or the wheelchair is folded up.

19 Claims, 21 Drawing Sheets

(56) References Cited

U.S. PATENT DOCUMENTS

| | | | | |
|---|---|---|---|---|
| 2004/0080138 | A1* | 4/2004 | Kimura | A61G 5/1027 280/250.1 |
| 2005/0087954 | A1* | 4/2005 | Wakita | A61G 5/10 280/304.1 |
| 2005/0248121 | A1* | 11/2005 | Ford | A61G 5/1018 280/304.1 |
| 2012/0038128 | A1* | 2/2012 | Nimura | A61G 5/1005 280/250.1 |
| 2016/0220432 | A1* | 8/2016 | Ooyama | A61G 5/1021 |

FOREIGN PATENT DOCUMENTS

| | | | |
|---|---|---|---|
| JP | 2004-016406 | A | 1/2004 |
| JP | 2010-069216 | * | 4/2010 |
| JP | 2010-069216 | A | 4/2010 |
| JP | 2012-20022 | * | 2/2012 |
| JP | 2012-020022 | A | 2/2012 |
| KR | 10-0947583 | B1 | 3/2010 |

* cited by examiner

[Fig. 1]
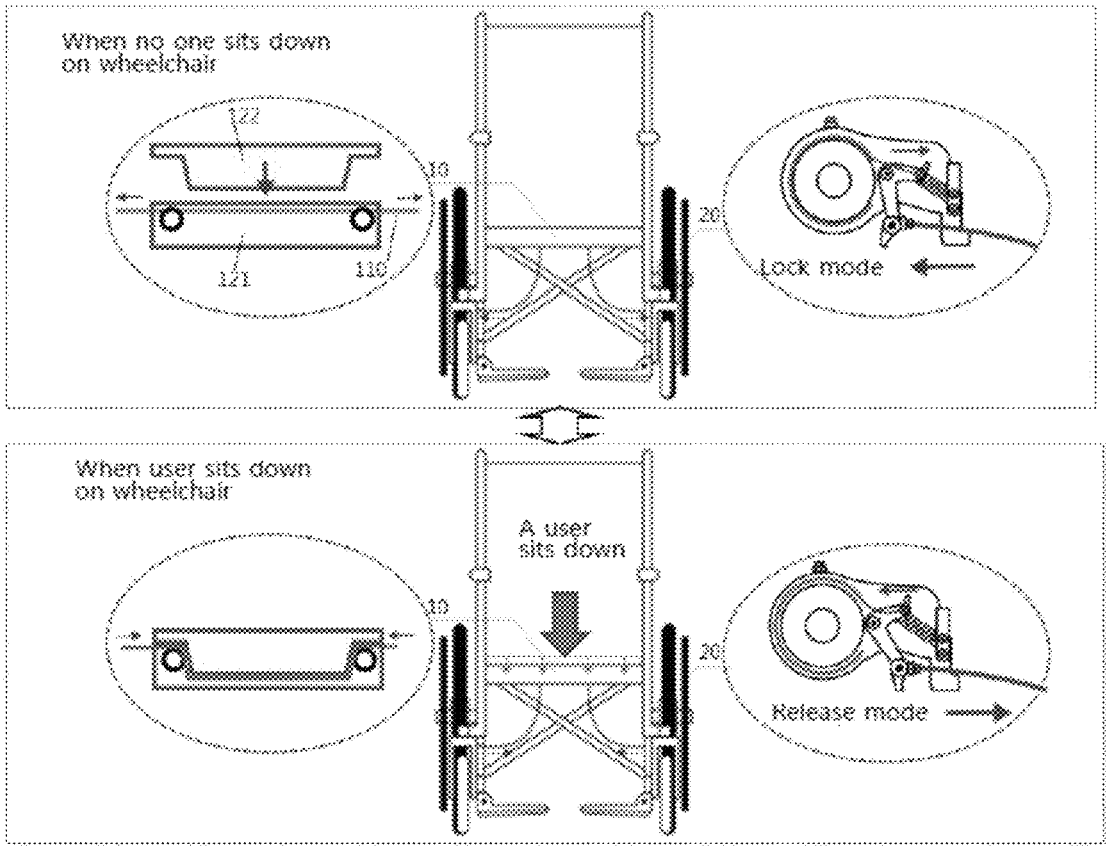

[Fig. 2]
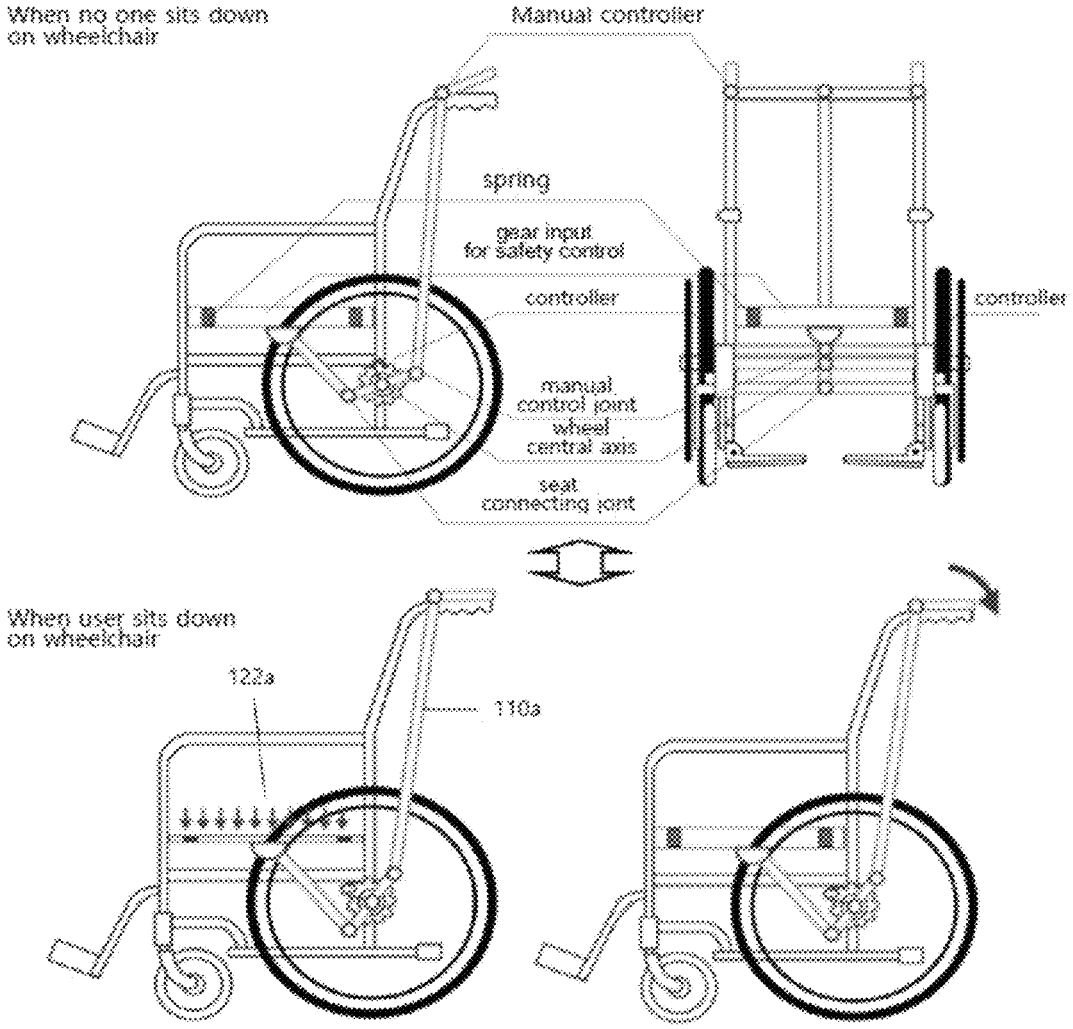

[Fig. 3]
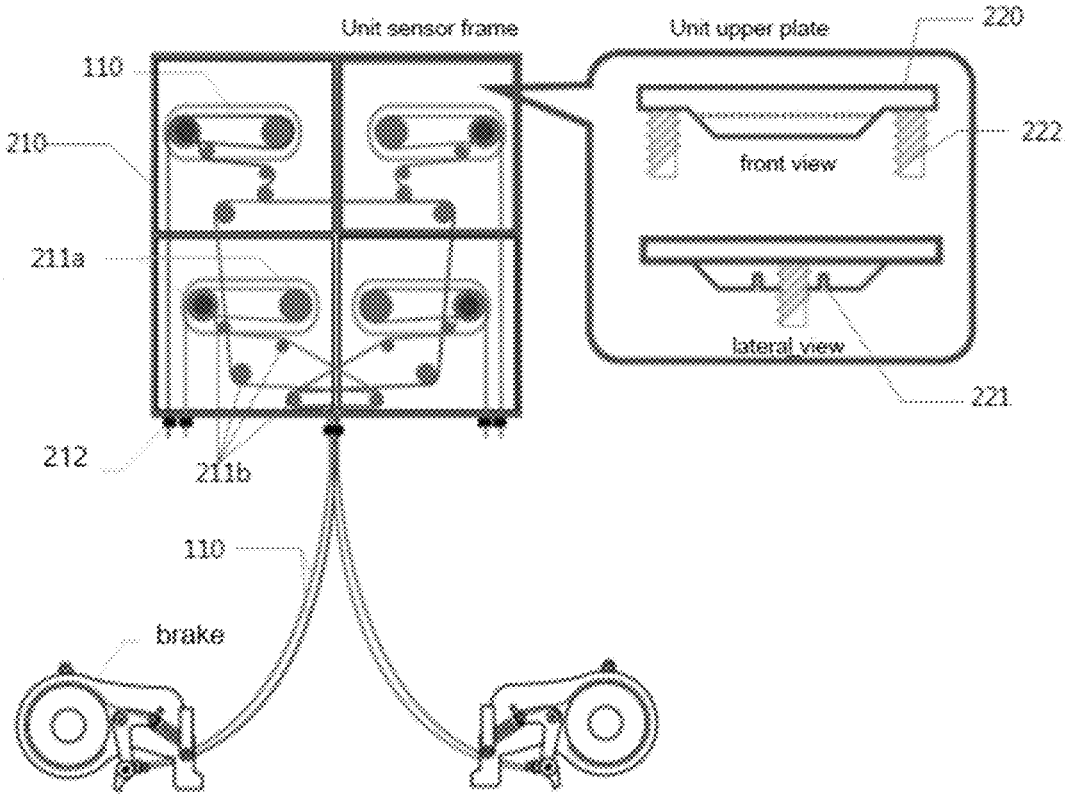

[Fig. 4]
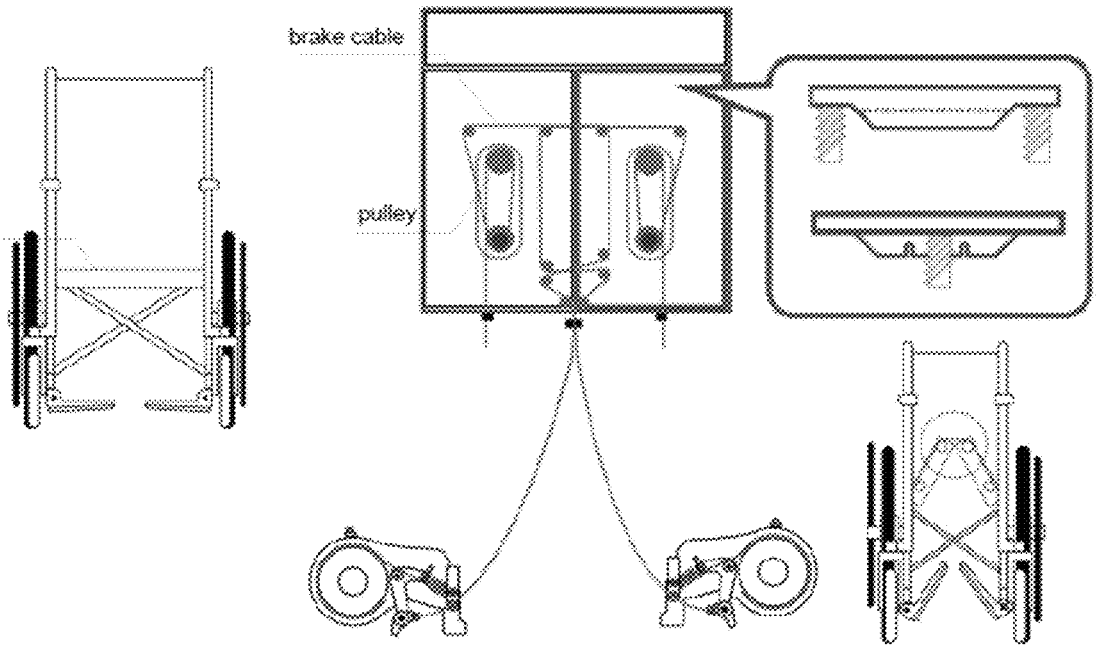

[Fig. 5]
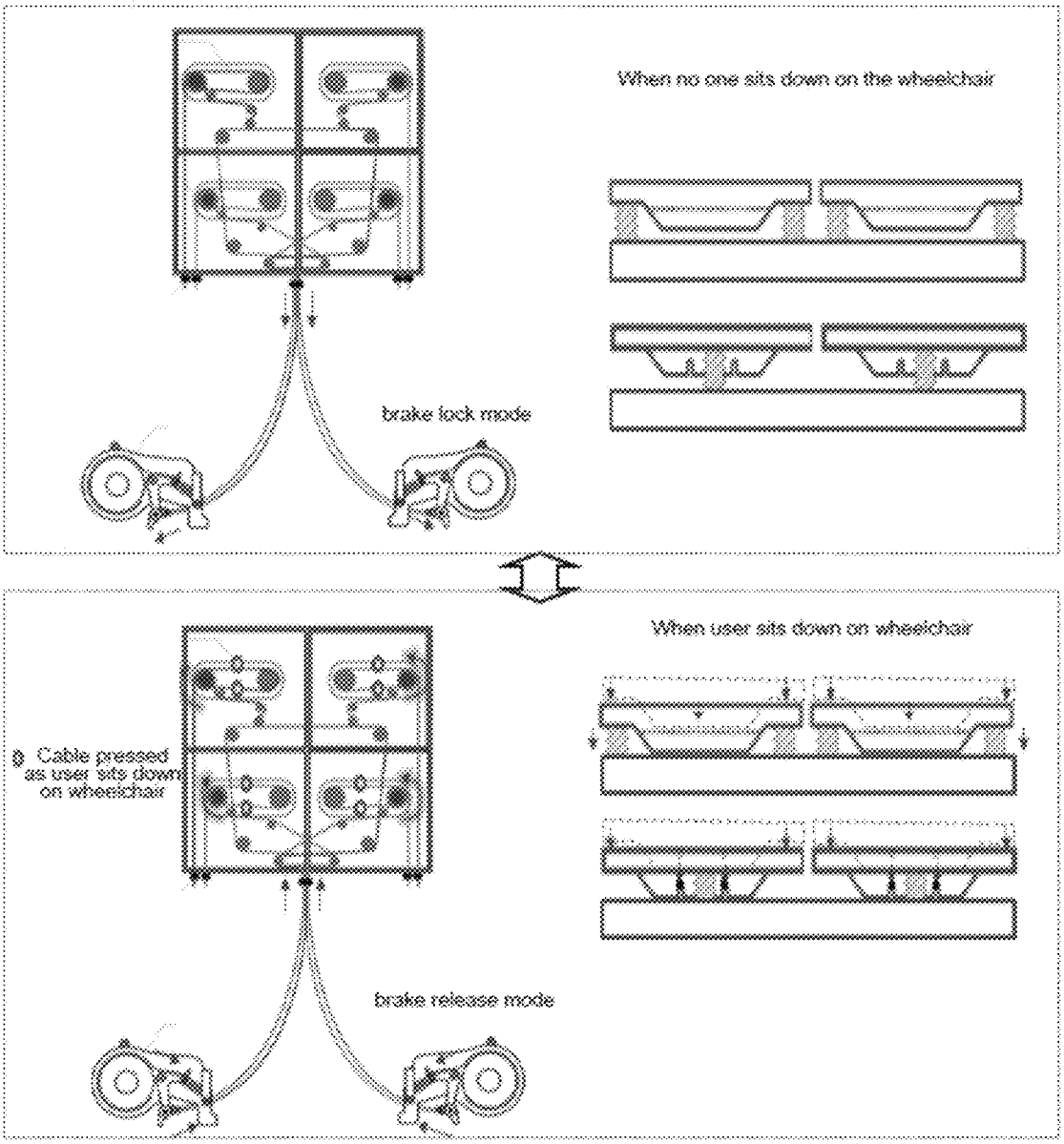

[Fig. 6]
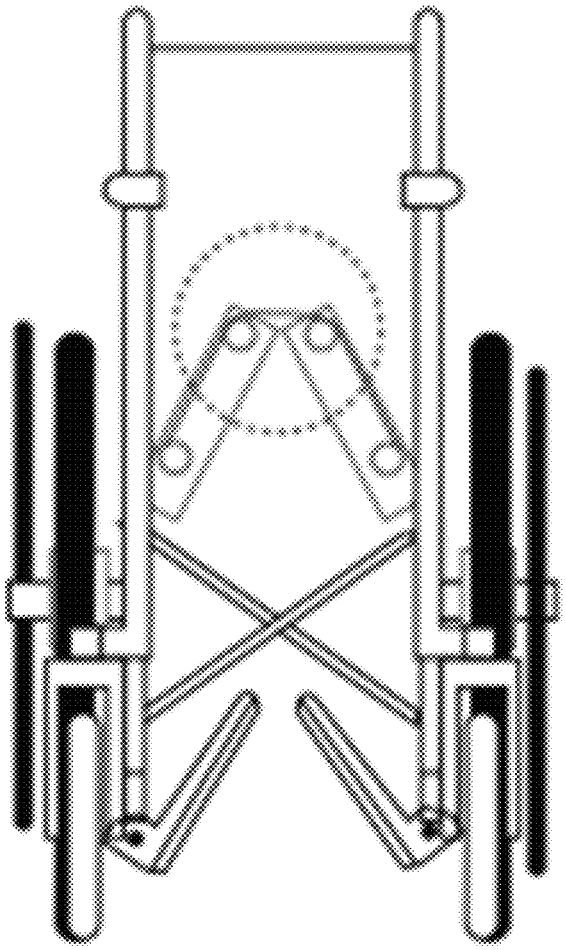

[Fig. 7]
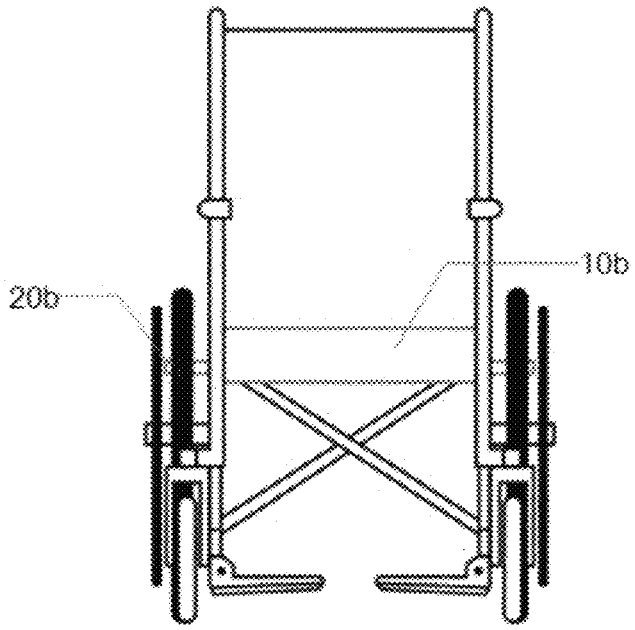
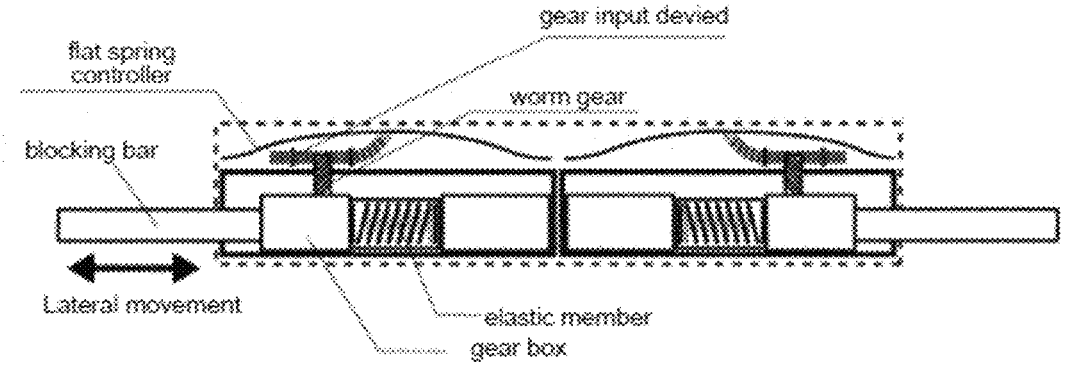

[Fig. 8]
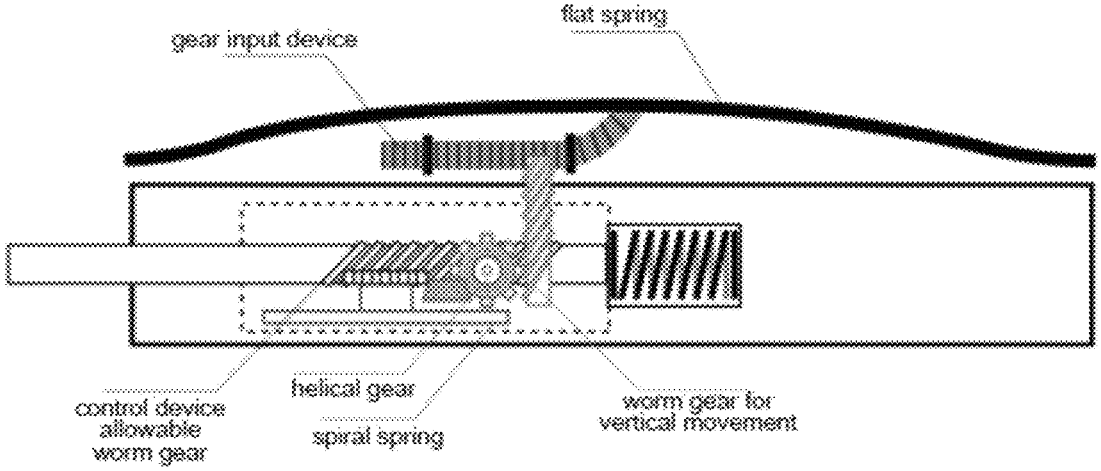
front view of gear box
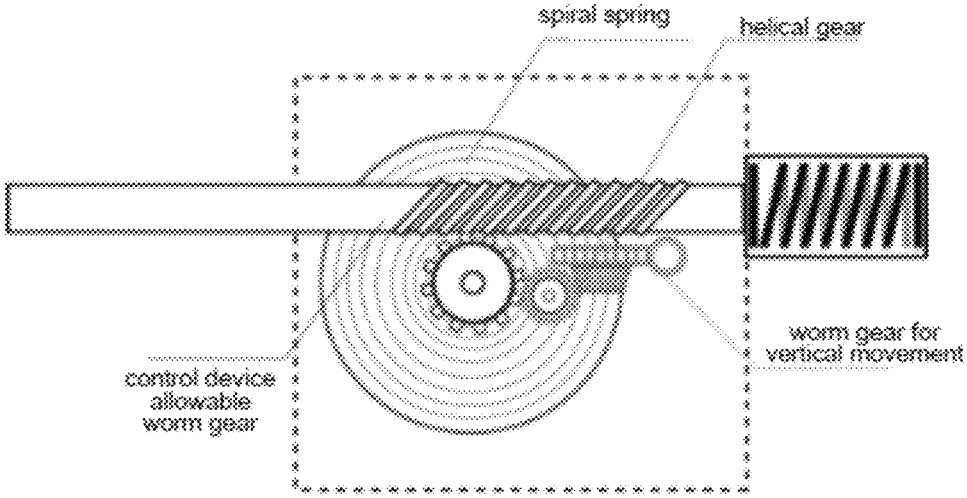

[Fig. 9]
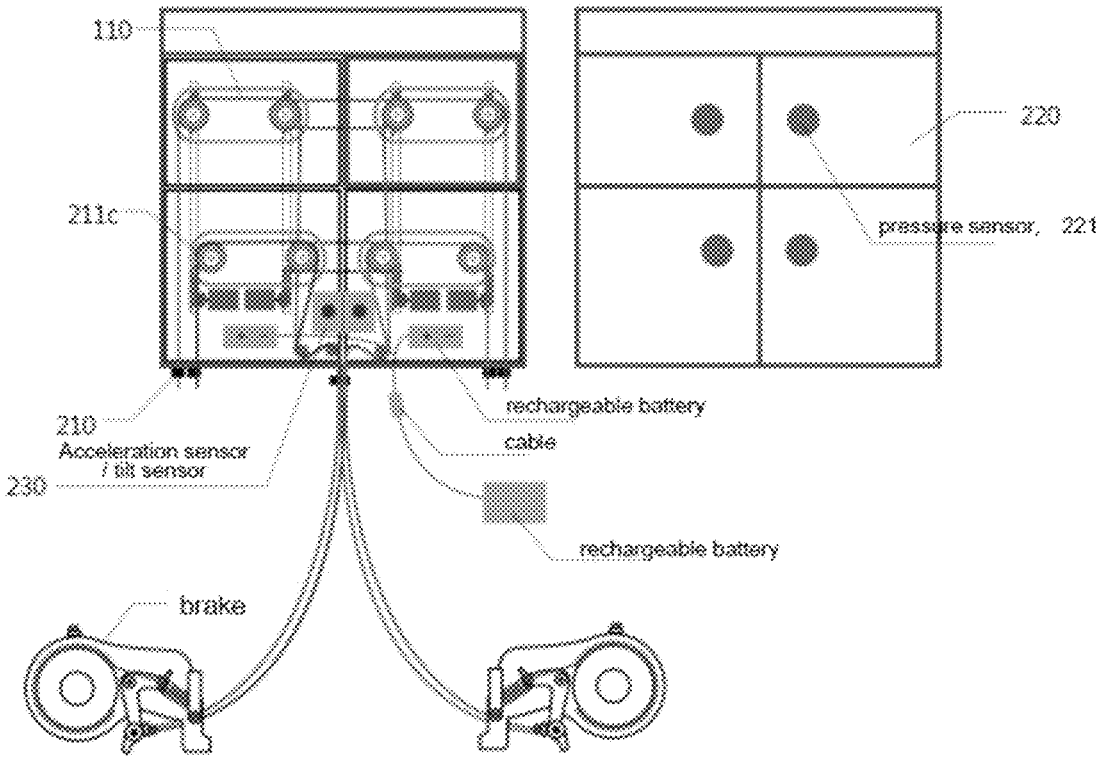

[Fig. 10]
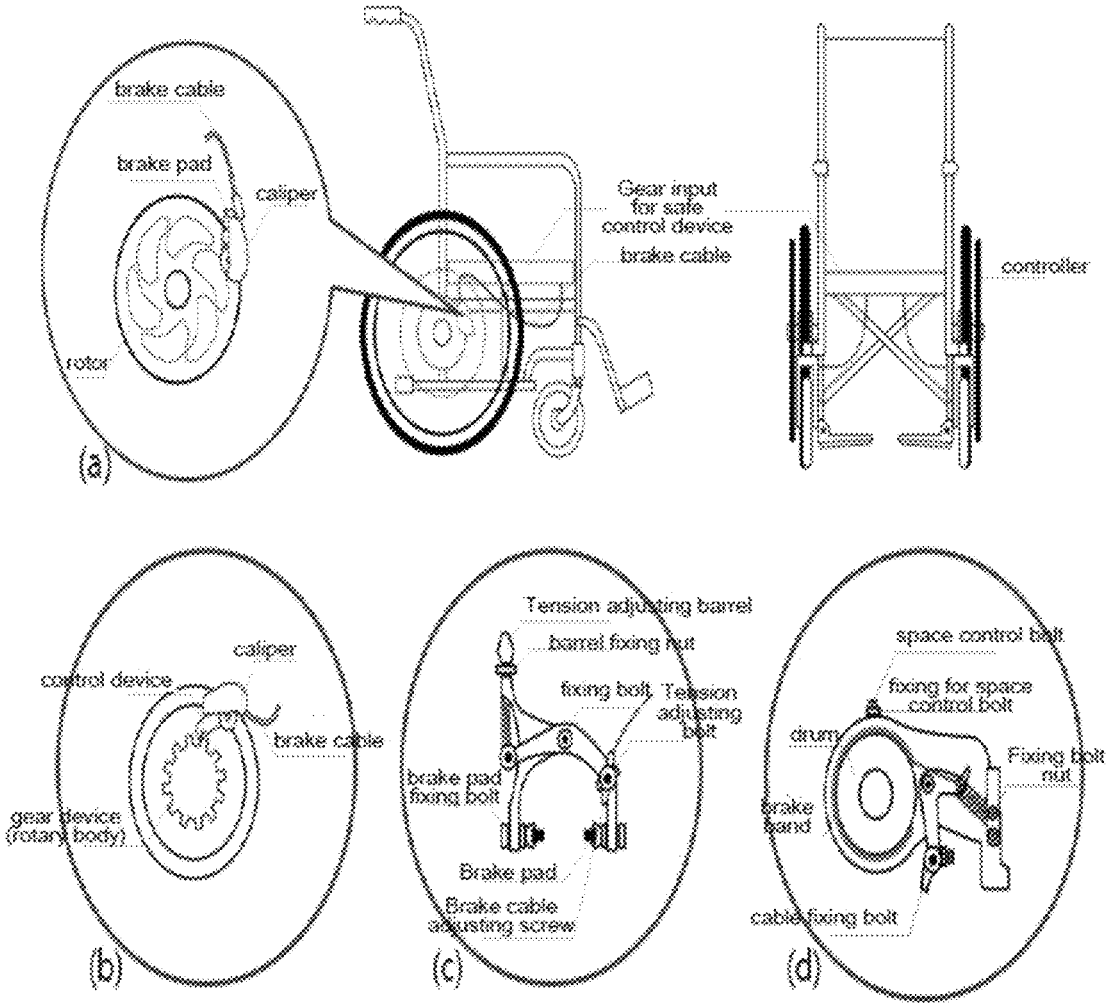

[Fig. 11]
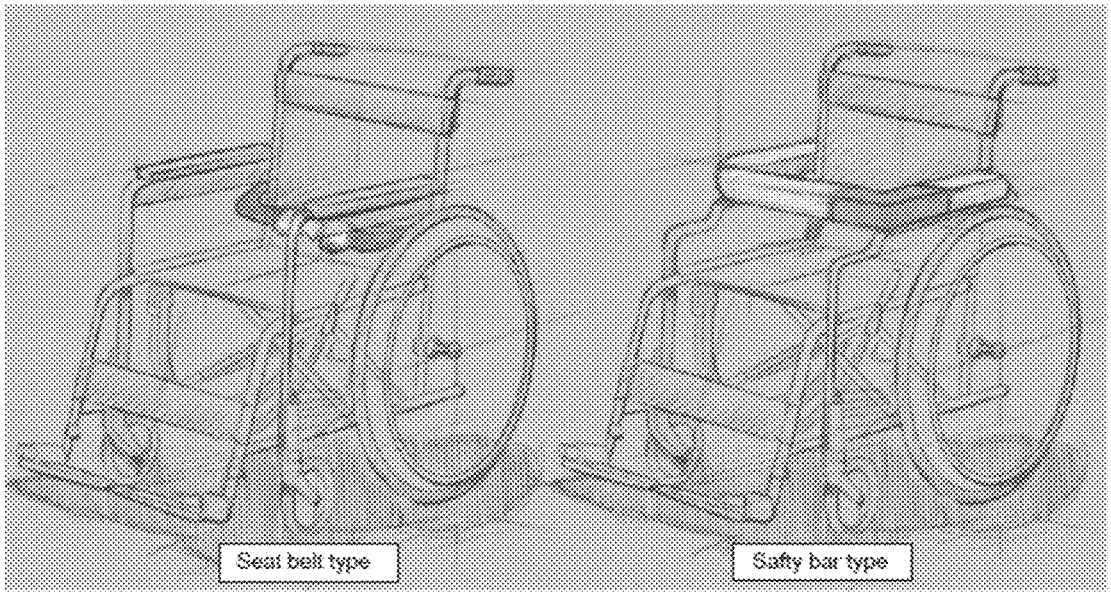

[Fig. 12]
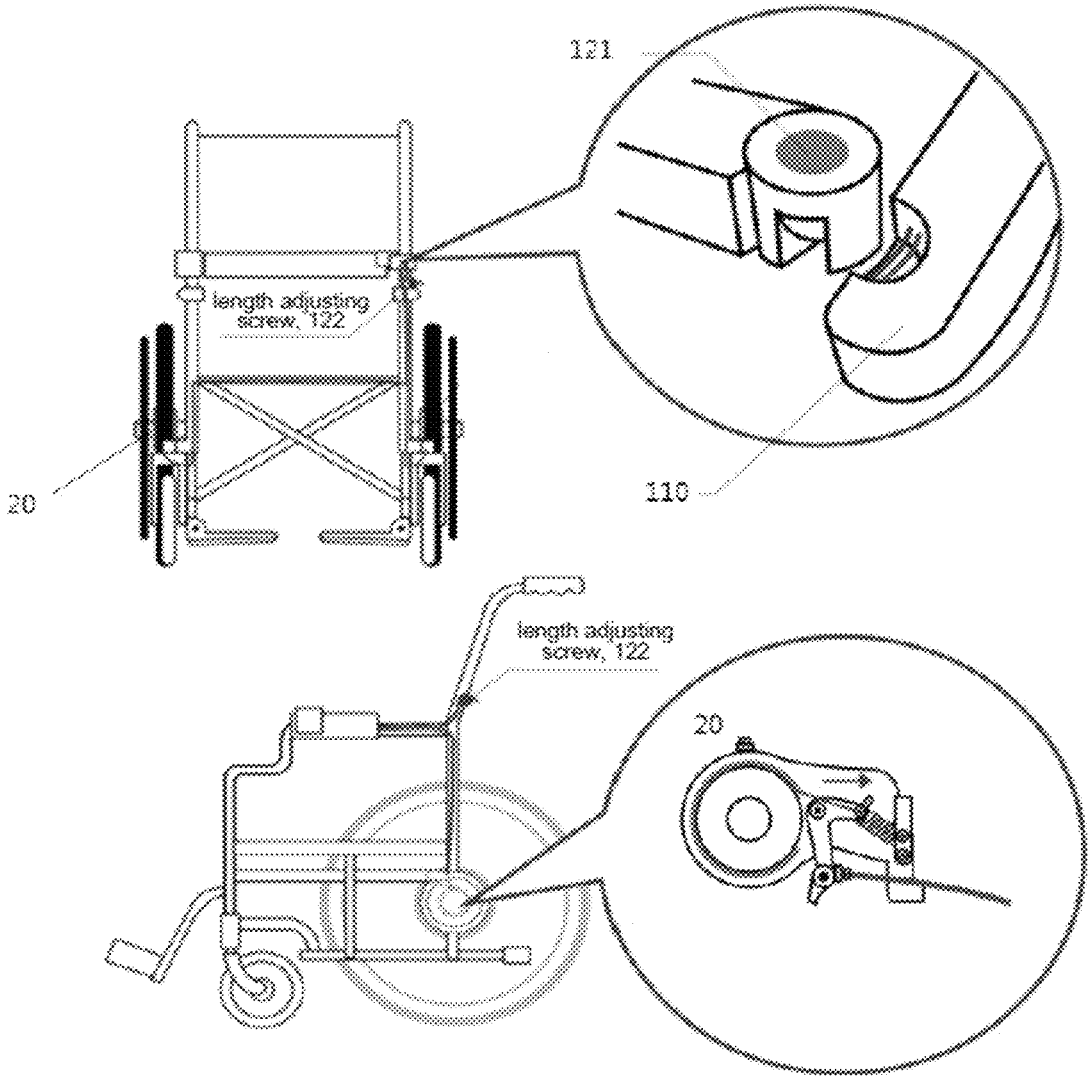

[Fig. 13]
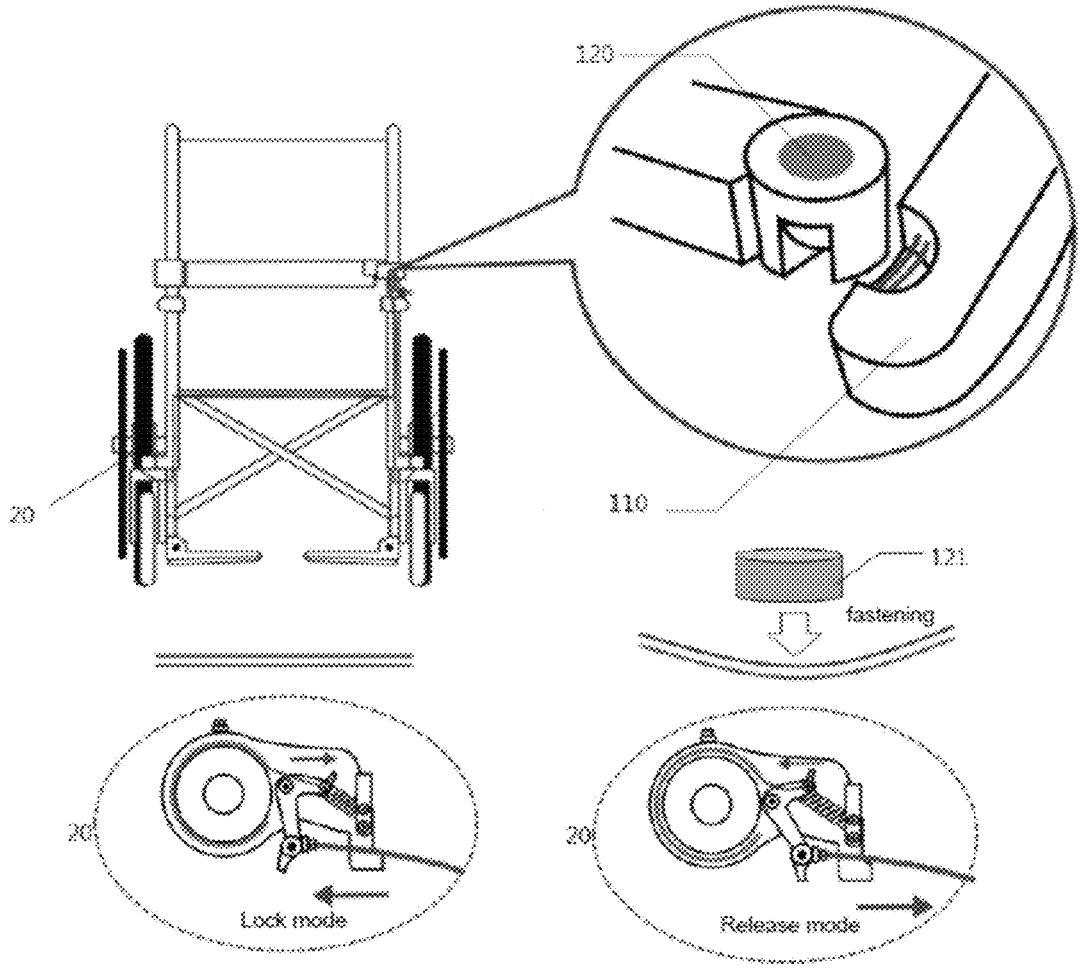

[Fig. 14]
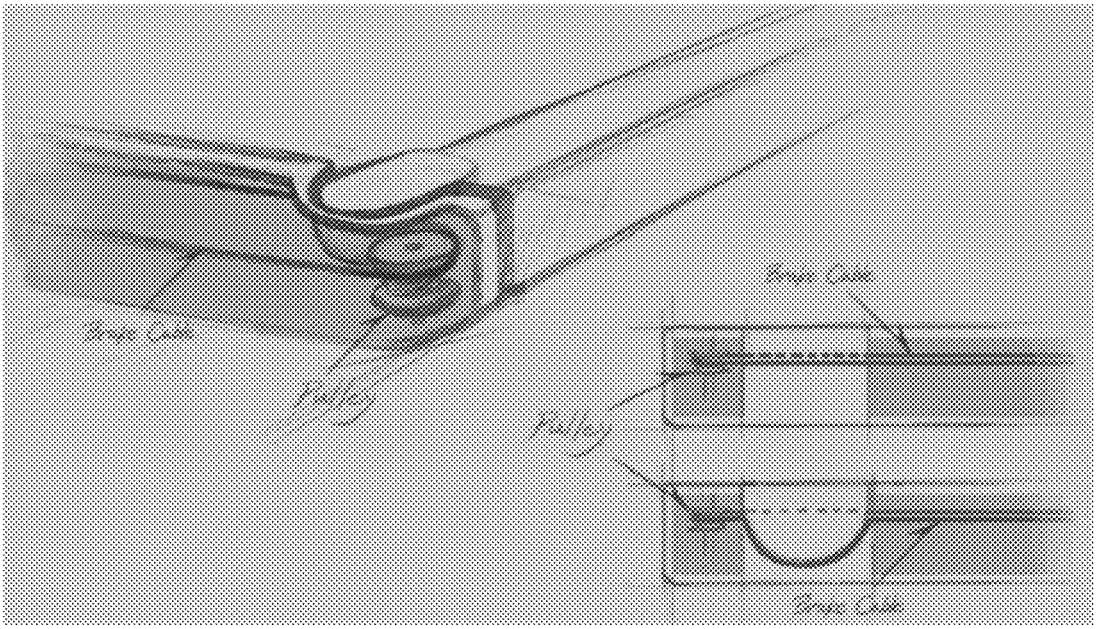

[Fig. 15]
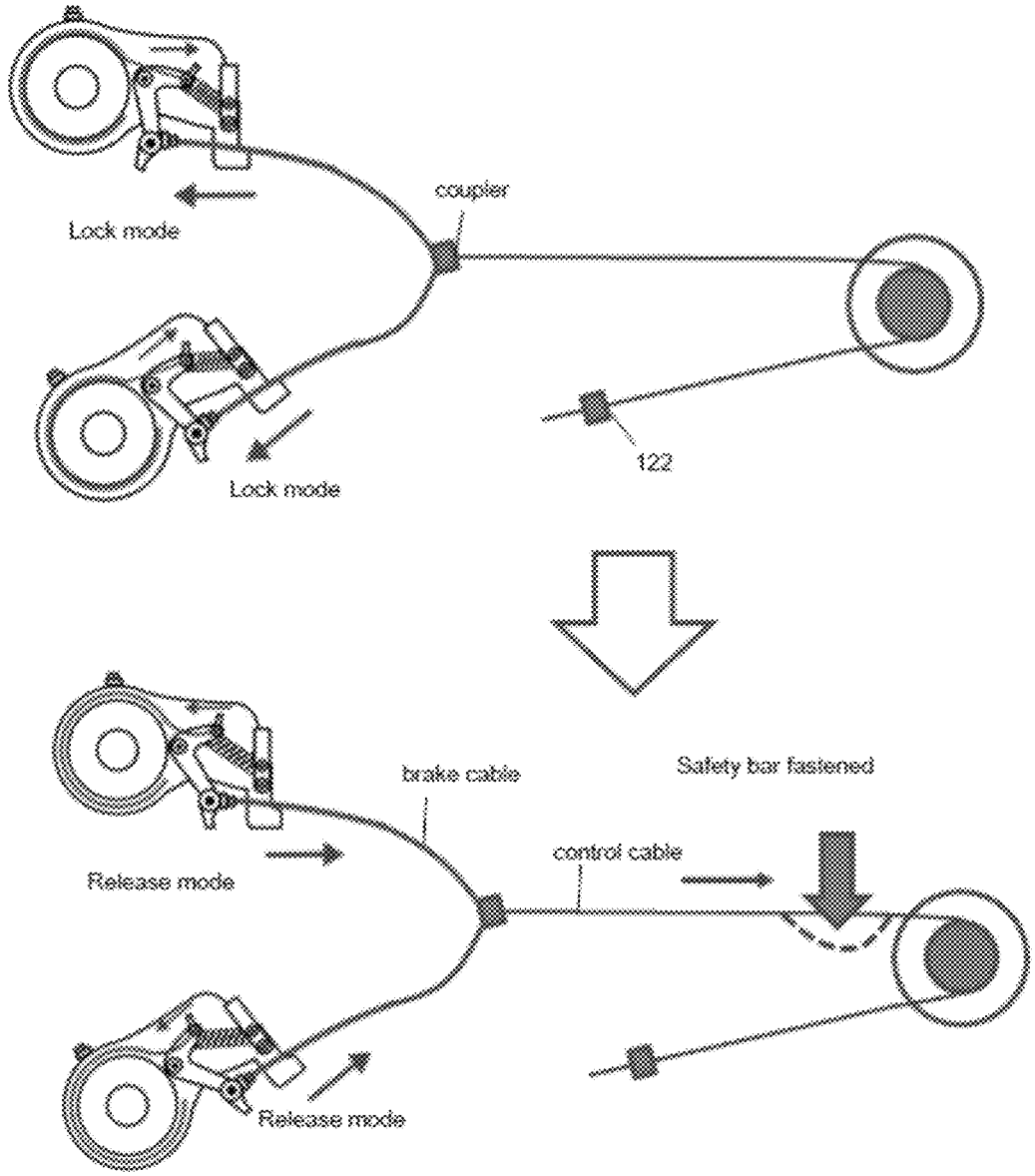

[Fig. 16]
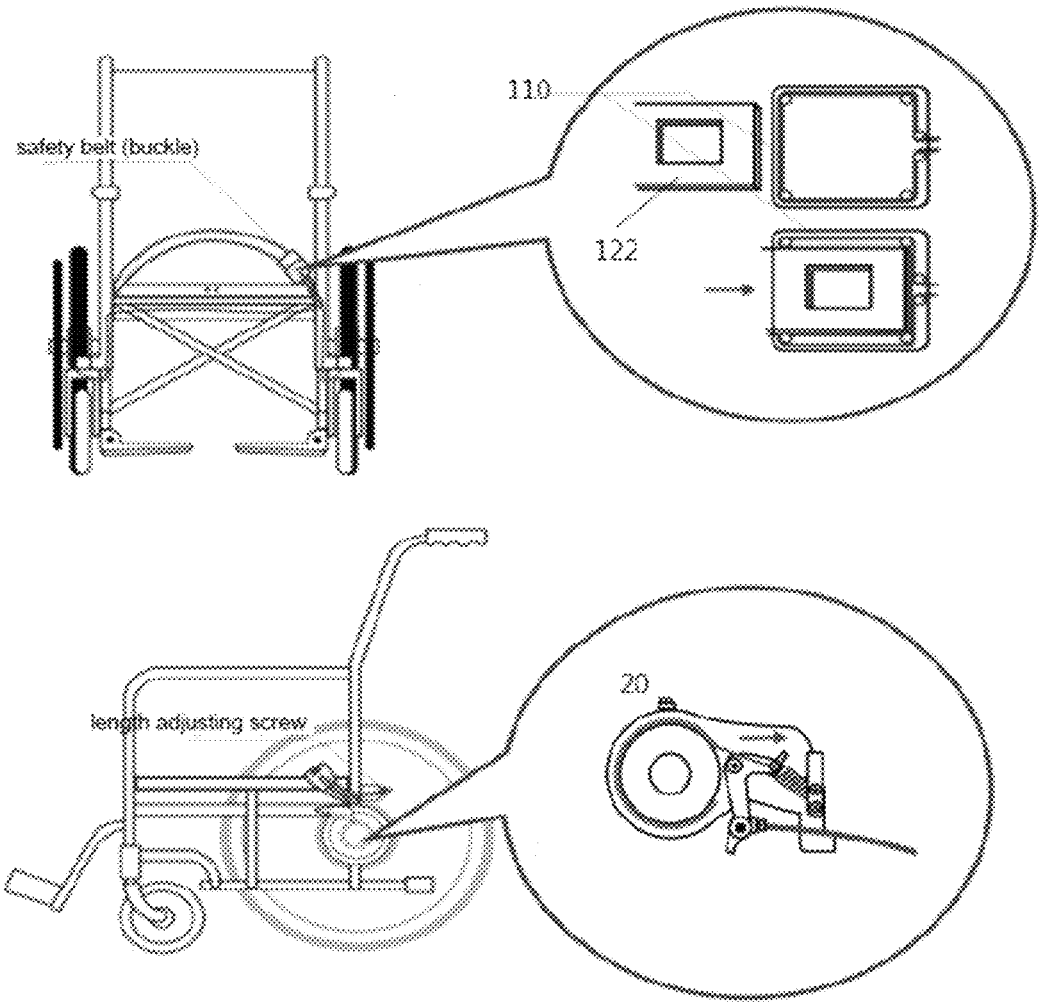

[Fig. 17]
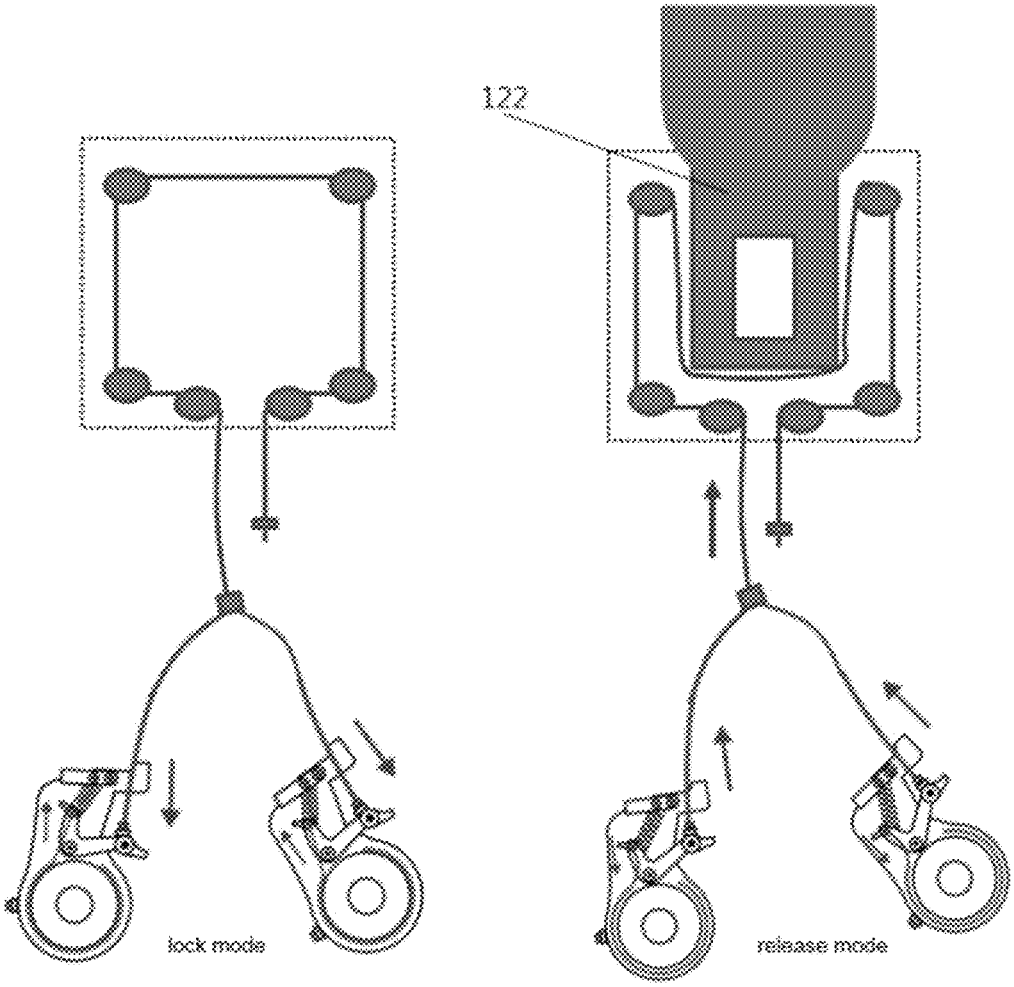

[Fig. 18]
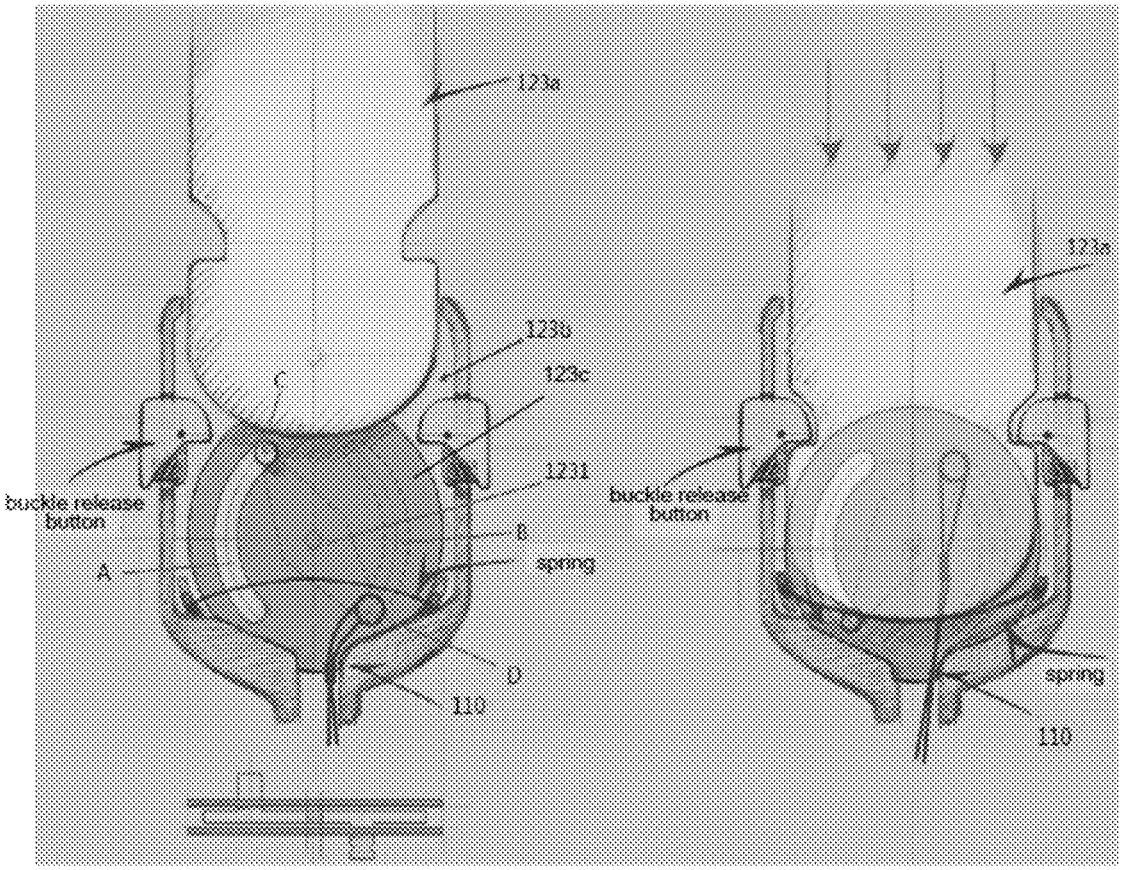

[Fig. 19]
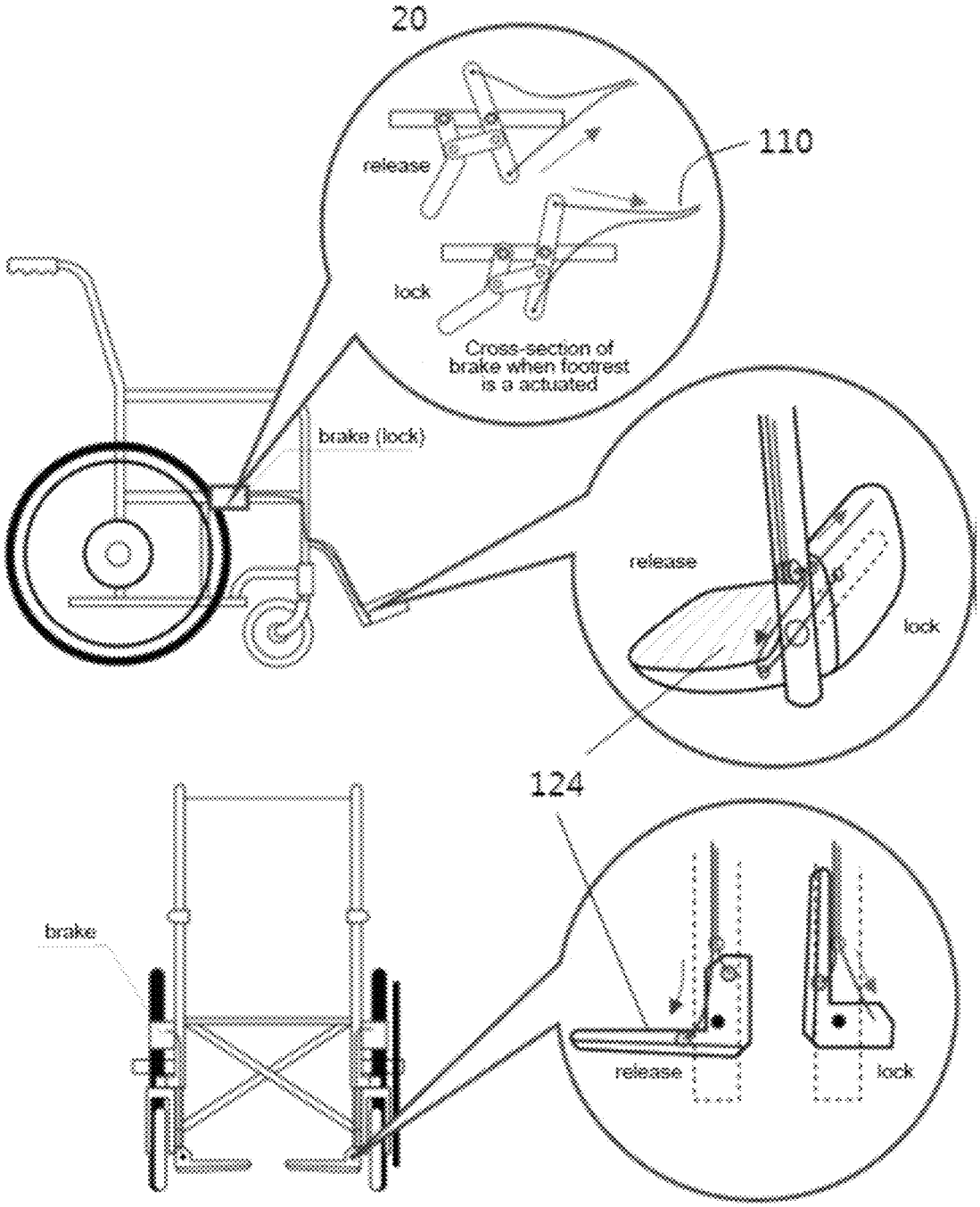

[Fig. 20]
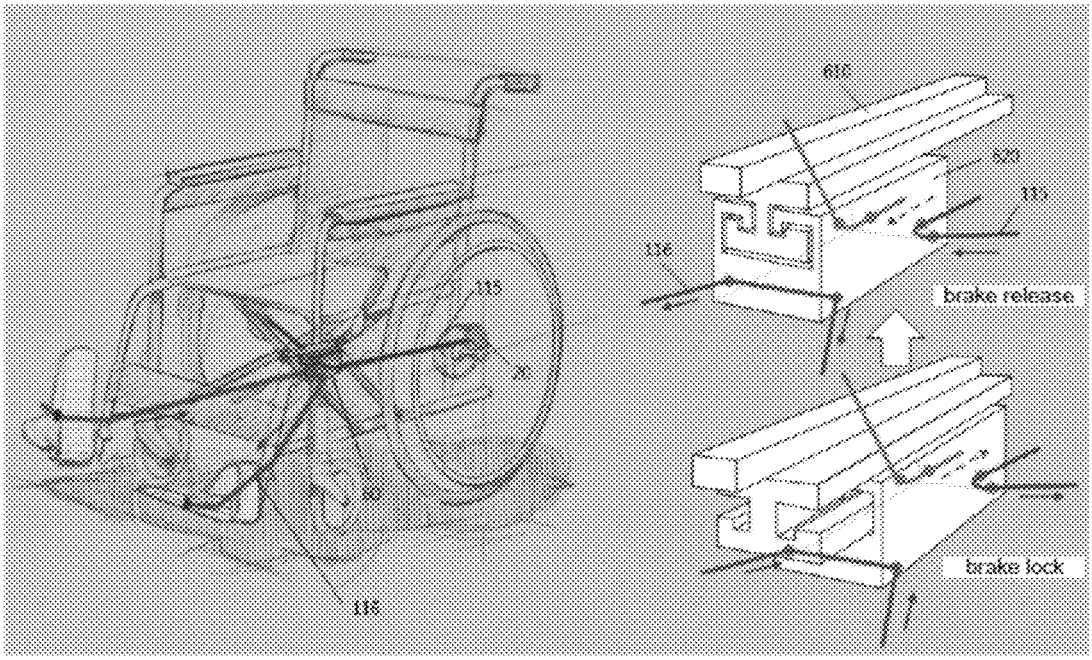

[Fig. 21]
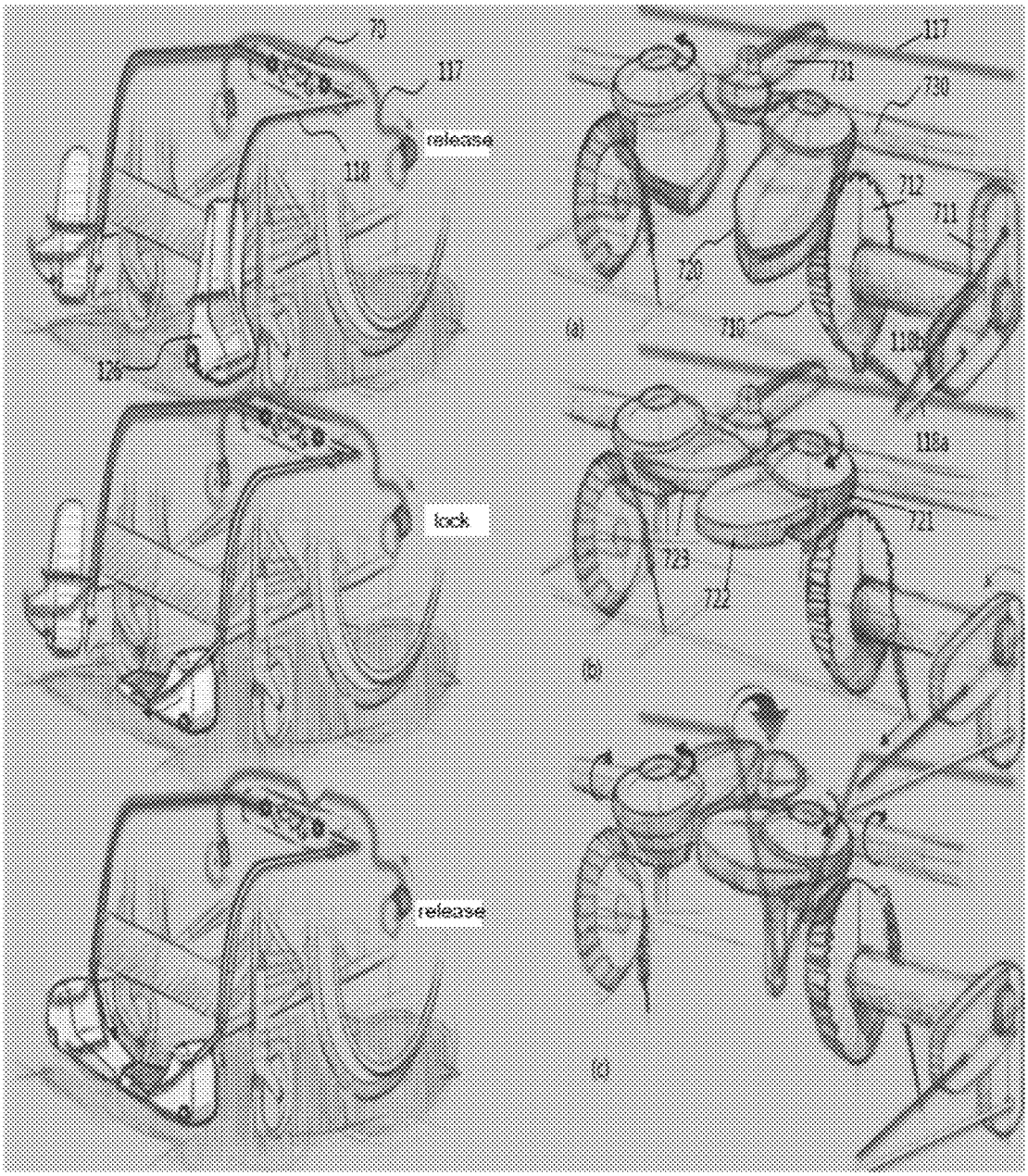

WHEELCHAIR BRAKE SYSTEM

CROSS REFERENCE TO PRIOR APPLICATIONS

This application is a National Stage Application of PCT International Patent Application No. PCT/KR2015/012553 filed on Nov. 20, 2015, under 35 U.S.C. § 371, which claims priority to Korean Patent Application Nos. 10-2014-0162755 filed on Nov. 20, 2014, 10-2014-0174131 filed on Dec. 5, 2014, and 10-2015-0018616 filed on Feb. 6, 2015, which are all hereby incorporated by reference in their entirety.

TECHNICAL FIELD

The present invention relates to a wheelchair brake system, and more particularly to a wheelchair brake system which is in a brake lock mode as usual as when a user stands up from a wheelchair, but automatically releases a brake only if a user sits down on the wheelchair or folds up the wheelchair, so that the wheelchair can move only when a user sits down thereon or it is folded, thereby preventing a user from getting hurt from a fall at a moment when the user sits down on and stands up from the wheelchair.

BACKGROUND ART

In general, a wheelchair refers to a means of transportation for a less able-bodied person, which is pushed by a person who is sitting down thereon or by an assistant from behind.

Since a user who needs the wheelchair is the less able-bodied person, it is very dangerous at a moment when s/he sits down on or stands up from the wheelchair. The wheelchair can move while the user is sitting down on or standing up from the wheelchair, and thus often cause accidents where the user gets hurt from a fall.

To solve the foregoing problems, there has been developed a wheelchair with a brake. However, a conventional wheelchair brake system still has a problem of causing the fall accidents since artificial control is needed to actuate the brake of the wheelchair like that of a bicycle.

DISCLOSURE

Technical Problem

The present invention is conceived to solve the foregoing problems, and an aspect of the present invention is to provide a wheelchair brake system which is in a brake lock mode to stop if no one sits down on a wheelchair, but releases a brake to move only if a user properly sits down on the wheelchair, thereby preventing a user from getting hurt from a fall due to movement of the wheelchair at a moment when the user sits down on and stands up from the wheelchair.

Technical Solution

A wheelchair brake system according to the present invention comprises; a brake which is provided in a wheel of a wheelchair; and a brake actuation controller which connects with the brake and locks and releases the brake, wherein the brake is usually in a lock mode, but the brake actuation controller controls the brake to be switched over from the lock mode to a release mode if sensing that a user sits down on the wheelchair or the wheelchair is folded up.

The brake actuation controller comprises: a connection member which has a first end elastically connecting with the brake; a brake switching member to which a second end of the connection member is fixed, and which actuates the connection member connecting with the brake to release the brake when a user sits down on the wheelchair, but returns the connection member to switch the brake over to the lock mode when the user stands up from the wheelchair.

The connection member comprises a cable or a bar; the brake switching member is non-motorized or motorized for automatic actuation.

The non-motorized brake switching member comprises: a sensing frame which is provided beneath a seat of the wheelchair, and accommodates a second end of the cable therein to be fixed and connected thereto; and an upper plate which couples with the sensing frame and changes tension of the cable by pressing the cable accommodated in the sensing frame when a user sits down on the seat.

The upper plate comprises a cable accommodator; the cable accommodator does not press the cable when no one sits down on the wheelchair, but presses the accommodated cable as the upper plate moves down when a user sits down on the wheelchair; and the brake is released since the cable is tensed in a direction opposite to the brake when the cable is pressed.

The sensing frame and the upper plate are divided into a plurality of units; at least one of cables is connected to the respective units is connected to the brake; and the brake is switched over from the lock mode to the release mode when at least one among the plurality of units is actuated.

The motorized brake switching member comprises: a sensing frame which is provided beneath a seat of the wheelchair, accommodates a second end of the cable therein to be fixed and connected thereto, and comprises an electric driver to electrically wind the cable to change tension; and an upper plate which couples with the sensing frame and comprises a sensor to sense whether a user sits down on the seat.

The electric driver comprises: an electric pulley for changing a winding direction of a cable, and winding the cable; a motor for providing torque to drive the electric pulley; and a driving controller for controlling the torque of the motor, and the electric driver drives the motor to rotate the electric pulley to make tension act in an opposite direction of the brake and release the brake when a pressure sensor provided in the upper plate senses that a user sits down on the wheelchair, but drives the motor to rotate in an opposite direction to rotate and return the electric pulley to its original position, to make the tension act toward the brake and to lock the brake when the user stands up from the wheelchair.

The electric driver further comprises a sensor unit such as an acceleration sensor and a tilt sensor, and the sensor unit is provided to make the brake be not only simply switched over between the lock mode and the release mode, but also automatically actuated for safety when the wheelchair moves at an excessively high speed or on a slope.

Advantageous Effects

According to an embodiment of the present invention, a wheelchair brake system has an effect on preventing a user from getting hurt from a fall due to movement of the wheelchair at a moment when the user sits down on and stands up from the wheelchair since it is in a brake lock mode to stop if no one sits down on a wheelchair, but releases a brake to move only if a user properly sits down on the wheelchair.

DESCRIPTION OF DRAWINGS

FIG. 1 schematically shows a wheelchair according to an embodiment of the present invention.

FIG. 2 schematically shows a wheelchair according to another embodiment of the present invention.

FIG. 3 schematically shows sensing frames and upper plates which are divided into four units according to an embodiment of the present invention.

FIG. 4 schematically shows sensing frames and upper plates which are divided into two units according to an embodiment of the present invention.

FIG. 5 schematically shows actuation of a brake in the wheel chair of FIG. 3.

FIG. 6 schematically shows that the wheelchair is folded up.

FIG. 7 schematically shows a wheelchair brake system according to still another embodiment of the present invention, and FIG. 8 is a detailed view of FIG. 7.

FIG. 9 schematically shows a motorized wheelchair brake system according to an embodiment of the present invention.

FIG. 10 schematically shows a brake according to an embodiment of the present invention.

FIG. 11 schematically shows that a switching member according to an embodiment of the present invention is a safety device given in the form of a safety bar or a seat belt, FIGS. 12 to 15 are detailed views of the safety bar provided as the switching member of FIG. 11, and FIG. 16 to FIG. 18 are detailed views of the seat belt provided as the switching member of FIG. 11.

FIGS. 19 to 21 schematically show a structure where a footrest is used as a switching member for the brake according to an embodiment of the present invention.

BEST MODE

To achieve the foregoing object, a wheelchair brake system according to the present invention includes a brake provided in a wheel of a wheelchair, and a brake actuation controller connected to the brake and locking and releasing the brake, in which the brake is usually in a lock mode but is released from the lock mode in sync with actuation of a safety device sensed by the brake actuation controller when a user sits down on the wheelchair.

MODE FOR INVENTION

Below, embodiments of the present invention will be described in detail with reference to the accompanying drawings.

FIG. 1 schematically shows a wheelchair according to an embodiment of the present invention.

Referring to FIG. 1, a wheelchair brake system according to an embodiment of the present invention includes a brake 20 provided in a wheel of a wheelchair, and a brake actuation controller 10 connected to the brake and locking and releasing the brake 20, in which the brake is usually in a lock mode but is released from the lock mode by the brake actuation controller 10 when a user properly sits down on the wheelchair or when the wheelchair is folded up.

The brake actuation controller 10 may include a connection member 110 having a first end connected to the brake, and a brake switching member 120 coupled to a second end of the connection member 110 and actuating the connection member 110 connected to the brake to release the brake when a user sits down on the wheelchair but return the connection member 110 to switch the brake over to the lock mode when a user stands up from the wheelchair.

In other words, the brake switching member 120 switches the brake over to a release mode if a user sits down on the wheelchair, and returns the connection member 110 to an original state to switch the brake over to the lock mode if a user stands up from the wheelchair or the wheelchair is unfolded.

In more detail, the connection member 110 may be achieved by a cable or bar, and the cable is set to give tension to the brake so that the brake can keep the lock mode if no one sits down on the wheelchair. Here, the cable refers to a member made of a wire (or a string).

That is, the brake is usually locked since the cable is kept to give tension so that the brake can be locked. However, the cable is automatically pulled in an opposite direction when a user sits down on the wheelchair, and thus the brake is released.

The brake switching member 120 may be non-motorized or motorized.

First, if the brake switching member 120 is non-motorized, the brake switching member 120 is placed beneath a seat of the wheelchair, and includes a sensing frame 121 holding, accommodating and connecting with a second end of the cable, and an upper plate 122 coupled to the sensing frame and pressing the cable accommodated in the sensing frame to switch a direction of applying the tension to the cable when a user sits down on the seat.

Specifically, the sensing frame 121 includes a cable accommodator, so that the cable accommodated in the cable accommodator can be free from pressure of the cable accommodator when no one sits down on the wheelchair, but be pressed by the cable accommodator as the upper plate moves down when a user sits down on the wheelchair.

If the cable is pressed as described above, the cable is tensed in an opposite direction to the brake and thus the brake is released from the lock mode.

Therefore, the brake is always kept in the lock mode if no one sits down on the wheelchair, but released only when a user sits down on the wheelchair.

FIG. 2 schematically shows a wheelchair according to another embodiment of the present invention.

Referring to FIG. 2, the connection member 110*a* is achieved by not the cable but a bar, in which the connection member has a first end connected to the brake actuation controller 122*a* and includes a plurality of joints.

The actuation controller 122*a* is elastically coupled as a plate to a bottom of the seat of the wheelchair, and is thus elastically disposed downward when a user sits down on the wheelchair and returns to an original position when the user stands up from the wheelchair.

Further, the connection member 110*a* includes a central shaft aligned with a central shaft of the wheel, so that the central shaft thereof can connect with the brake of the wheel by the cable.

Therefore, when no one sits down on the wheelchair, the brake is in the lock mode by initial tension. On the other hand, when a user sits down on the wheelchair, the actuation controller 122*a* is elastically displaced downward and the connection member 110*a* integrally coupled to the actuation controller 122*a* is also displaced by the elastic displacement, thereby actuating the cable connected to the brake in the opposite direction to the initial tension and thus releasing the brake from the lock mode.

FIG. 3 schematically shows the sensing frames and the upper plates which are divided into four units according to an embodiment of the present invention.

In this embodiment, the upper plate is divided into four units, but not limited thereto. Alternatively, the upper plate may be divided into two units as shown in FIG. 4. Likewise, it will be appreciated that the upper plate may be designed to be divided into various numbers of sections.

Referring to FIG. 3, the sensing frame 210 is sectioned into four units, and each unit is formed with a pulley assembly, thereby connecting with the connection member of the cable through the pulley assembly.

The pulley assembly may include a main pulley 211*a* for directly affecting the lock/release of the brake, and a sub pulley 211*b* for changing a direction of the cable without directly affecting the lock/release of the brake lock.

In each of four units, two main pulleys 211*a* are spaced apart at a predetermined distance and form a pair, and the cable is at least once wound on one main pulley and connected to the brake via the sub pulley 211*b*.

Like the number of divided units, there may be four cables. One cable is coupled to each unit, and two cables among four cables form a pair. Thus, the pair of cables is connected to each of two brakes.

In this embodiment, a first cable coupled to a first unit and a fourth cable coupled to a fourth unit form a pair and are connected to a first brake, and a second cable coupled to a second unit and a third cable coupled to a third unit form a pair and are connected to a second brake.

To adjust the tension of each cable, a screw adjuster 212 is provided at each starting point of the four cables.

Likewise, the upper plate is divided into four. Each of the upper plates includes the cable accommodator 221 placed beneath the plate, and a coupling member 222 for coupling with the sensing frame.

The coupling member 222 is provided as a spring for elastically coupling with the sensing frame so that the upper plate can move up and down in accordance with whether a user sits down on the wheelchair.

Further, the cable accommodator 221 includes a protrusion bar protruding from the bottom of the plate, and a cable groove formed in the protrusion bar.

To accommodate the cable wound on a pair of main pulleys, two cable grooves are formed as shown in FIG. 3.

As described above, the upper plate is divided into four sections, and a pair of brakes connects with two cables, so that the brake can be released when at least one among four units is pressed by adjusting the tension of the brake connected to the cable.

For example, the brake is released if one unit connected to the pair of brakes is pressed by adjusting the tension of the cable. Alternatively, the brake may be released if four units are all pressed.

FIG. 5 schematically shows actuation of a brake in the wheel chair of FIG. 3.

Referring to FIG. 5, the brake keeps the lock mode since the tension of the cable is applied to the brake in an initial state where no one sits down on the wheelchair.

Here, the cable has the first end connected to the brake, and the second end connected to a cable adjuster 212 of the sensing frame. The cable adjuster 212 is an element of using an adjusting screw to adjust the tension of the cable, and serves as a fixed end. The first end of the cable coupled to the brake serves as an elastic end to reverse the direction of the tension by external forces.

When a user sits down on the wheelchair, the upper plate elastically coupled to the sensing frame moves down and the cable accommodated in the cable groove of the cable accommodator is pressed downward.

As described above, if the cable is pressed downward, the main pulley rotates as much as the displacement of the pressed cable. At this time, since the second end is the fixed end, pulling tension is generated at the elastic end coupled to the brake, thereby reversing the tension of acting toward the brake and thus releasing the brake from the lock mode.

Here, the upper plate is divided into four units, and one brake connects with two cables connected to two units, so that the direction of the tension acting on the brake can be reversed to release the brake if at least one among four units is pressed, thereby releasing the brake only when a user sits down on the wheelchair.

By adjusting the tension of the cable, it will be freely determined how many units among four units have to be pressed to release the brake.

FIG. 6 schematically shows that the wheelchair is folded up.

Referring to FIG. 6, when the wheelchair is folded, bending causes tension to be generated to pull the cable. Since the second end is the fixed end, the pulling tension is generated at the elastic end coupled to the brake, thereby reversing the direction of the tension acting toward the brake and thus releasing the brake from the lock mode.

FIG. 7 schematically shows a wheelchair brake system according to still another embodiment of the present invention, and FIG. 8 is a detailed view of FIG. 7.

Referring to FIGS. 7 and 8, the wheelchair brake system according to the present invention employs a blocking bar 20*a* as a brake. When no one sits down on the wheelchair, the blocking bar 20*a* passes through and is caught in spokes of the wheel, thereby making the wheelchair be in the lock mode.

On the other hand, when a user sits down on the wheelchair, the blocking bar 20*a* elastically moves to the inside of the wheel and is thus released from the lock mode.

Here, the brake actuation controller 10*a* includes a flat spring formed beneath the seat of the wheelchair, a gear box for changing elasticity of the flat spring into mechanical displacement, and an elastic member formed behind the gear box, so that the blocking bar can move inward as the elastic member is compressed as much as the displacement caused by the gear box.

Further, when a user stands up from the wheelchair, the elasticity of the flat spring is removed to cause the mechanical displacement of returning a gear assembly to its original position, and the compressed elastic member returns to its original position by restoring force, thereby making the blocking bar pass through the spokes of the wheel and enter the lock mode.

Below, an embodiment where the brake switching member is motorized will be described.

FIG. 9 schematically shows a motorized wheelchair brake system according to an embodiment of the present invention.

Referring to FIG. 9, the brake switching member in this embodiment includes a sensing frame provided beneath the seat of the wheelchair, fixing and accommodating the second end of the cable therein, and having an electric driver electrically winding the cable to reverse the direction of the tension; and an upper plate coupling with the sensing frame, and having a pressure sensor 221 to sense whether a user sits down on the wheelchair.

The electric driver may include an electric pulley for winding the cable, a motor for providing torque to drive the electric pulley, and a driving controller for controlling the torque of the motor, and reverse a direction of winding the cable.

The driving controller controls the motor to turn the electric pulley in an opposite direction to the tension when the pressure sensor 221 installed in the upper plate senses that a user sits down on the wheelchair.

With this, the tension acting toward the brake is reversed, and thus the brake is released from the lock mode. Since detailed principles of locking and releasing the brake are the same as those of a mechanical brake, detailed descriptions will be omitted.

Then, if a sensed value of the pressure sensor is changed as a user stands up from the wheelchair, the driving controller returns the electric pulley to its original position, thereby changing the direction of the tension again toward the brake and thus switching the brake over from the release mode to the lock mode.

Here, the sensing frame and the upper plate may be divided into a plurality of units so that the brake can be switched over between the release mode and the lock mode like the mechanical brake only when a user properly sits down on or stands up from the wheelchair.

Further, the electric driver may further include a sensor unit 230 such as an acceleration sensor and a tilt sensor.

With this sensor unit 230, the brake is not only simply switched over between the lock mode and the release mode, but also automatically actuated for safety when the wheelchair moves at an excessively high speed or on a slope.

In other words, if the sensor unit senses that the wheelchair moves at a high speed or on a downhill road, the brake is not fully switched over to the lock mode, but partially actuated to provide braking force, thereby decreasing the speed for safe movement.

Further, the acceleration sensor is additionally provided to sense the speed of the wheelchair, so that the electric pulley can be driven to actuate the brake if the sensed speed exceeds a specific speed (e.g. set within a range of 5~10 km per hour).

Here, a locking level of the brake is adjusted in accordance with the exceeded speed, thereby controlling the actuation of the electric pulley and thus securing safe movement.

FIG. 10 schematically shows a brake according to an embodiment of the present invention.

According to the present invention, the brake may be variously classified into (a) a brake pad type, (b) a caliper type generally used for a baby carriage, (c) a rim brake type generally used for a bicycle, (d) a band brake type, etc. In case of a motorized brake system, the band brake type is recommended since it is easy to adjust the locking level of the brake.

FIG. 11 schematically shows that a switching member according to an embodiment of the present invention is a safety device given in the form of a safety bar or a seat belt, FIGS. 12 to 15 are detailed views of the safety bar provided as the switching member of FIG. 11, and FIG. 16 to FIG. 18 are detailed views of the seat belt provided as the switching member of FIG. 11.

Referring to FIG. 11, the wheelchair brake system according to the present invention may be configured to release the brake only when the safety bar or the seat belt is fastened after a user sits down on the wheelchair.

The wheelchair brake system according to the present invention includes a brake 20 provided in a wheel of a wheelchair, and a brake actuation controller 10 connected to the brake 20 and locking and releasing the brake 20, in which the brake is usually in a lock mode but is released from the lock mode by the brake actuation controller 10 interlocking with the safety bar or the seat belt as the brake actuation controller 10 automatically senses that a user sits down on the wheelchair and fastens the safety bar or the seat belt.

The brake actuation controller 10 includes a connection member 110 connected to the brake, and a brake switching member 120 coupled to a second end of the connection member 110 and actuating the connection member 110 connected to the brake to release the brake when a user sits down on the wheelchair and fasten the safety device but return the connection member to its original position to switch the brake over to the lock mode when a user unfasten the safety device.

In other words, the brake switching member 120 switches the brake over to a release mode by pressing the connection member and reversing the direction of the tension acting on the brake if a user fastens the safety device after sitting down on the wheelchair, but returns the connection member to its original position of applying the tension toward the brake with restoring force to switch the brake over to the lock mode if a user sitting down on the wheelchair unfastens the safety device.

In more detail, the connection member 110 may be achieved by a cable or string, the tension of which is adjustable, and the cable is set to give the tension to the brake so that the brake can keep the lock mode if no one sits down on the wheelchair. Here, the cable refers to a member made of a wire (or a string).

That is, the brake is usually locked since the cable is kept to give tension so that the brake can be locked. However, the cable is automatically pulled in an opposite direction as much as displacement of the pressed connection member when a user sits down on the wheelchair and fastens the safety bar or the seat belt, thereby releasing the brake.

The brake switching member 120 may be non-motorized or motorized.

The brake switching member 120 in this embodiment using the safety bar, the seat belt or a footrest to be described later has the same operations and effects as those of adjusting the tension of the cable to lock and release the brake.

FIG. 12 shows the wheelchair with the safety bar, in which, in which the safety bar 121 serves as the brake switching member 120, and the brake keeps the lock mode since the tension of the cable acts toward the brake before fastening the safety bar 121.

The cable has a first end as a fixed end since it is fixed to the brake, and a second end for adjusting tension since it is coupled to a tension adjusting member 122.

Further, the cable has the first end coupled to the brake and connected to the inside of the safety bar, and is also connected to a tension adjusting member 122 through a pulley.

As shown in FIGS. 14 and 15, the cable includes brake cables connecting with two brakes, and a control cable connecting with the a tension adjusting member 122, in which the brake cable and the control cable are coupled by a coupler. Through the coupler, two brake cables and the control cable are operated as a single body.

When a user sits down on the wheelchair and fastens the safety bar 121, the control cable placed in the safety bar is pressed and the cable in the direction of the brake cable is pulled since the tension adjusting member 122 connected through the pulley is fixed, thereby generating tension in the opposite direction to the brake cable. Thus, the tension of the cable toward the brake is reversed so that the brake can be released from the lock mode.

On the other hand, if the safety bar 121 is unfastened, the tension acting on the cable inside the safety bar is removed and thus the tension of the cable is applied again toward the brake, thereby switching the brake over from the release state to the lock mode.

Therefore, the brake is released only when a user sits down on the wheelchair and fastens the safety bar 121, and it is thus possible to further secure user safety.

FIG. 13 shows the wheelchair with the seat belt, in which the seat belt 122 serves as the brake switching member 120, and the brake keeps the lock mode since the tension of the cable acts toward the brake before fastening the seat belt 122.

The embodiment of FIG. 13 has the same principle as the embodiment of FIG. 11, and different in that the tension of the cable connected to the brake is changed in direction in accordance with whether the seat belt is fastened or not, so that the brake can be switched over between the lock mode and the release mode.

In FIGS. 12 and 13, the seat belt is achieved by a buckle, in which the cable connecting with the brake is positioned inside a fastening frame, i.e. a buckle inlet to which a buckle 122 is fastened, and thus the cable is pressed when the buckle 122 is coupled to the buckle inlet of the fastening frame in order to fasten the seat belt. As the cable is pressed, the tension acting toward the brake is reversed to thereby release the brake from the lock mode.

Here, the cable is coupled to the inside of the fastening frame through a plurality of pulleys, and thus pulled as much as inward displacement of the cable when the buckle 122 presses the cable, thereby reversing the tension acting toward the brake and releasing the brake. On the other hand, if the buckle 122 is separated from the fastening frame, the cable is returned to its original position and force of pulling the cable is removed, thereby returning the tension of the cable toward the brake and locking the brake.

FIG. 18 schematically shows a seat belt according to another embodiment of the present invention.

Referring to FIG. 18, a guide member 123*c* for switching over the tension direction of the cable is provided inside a fastening frame 123*b*. As a buckle 123*a* is inserted in and fastened to the fastening frame 123*b*, the guide member 123*c* causes displacement of the cable and thus pulls the cable, thereby reversing the tension acting on the brake and releasing the brake from the lock mode.

In more detail, the guide member 123*c* includes two opposite guide grooves A and B respectively formed in front and rear sides thereof, and a moving member 1231 having a front projection C protruding above from the front guide groove A and a rear projection D protruding below from the rear guide groove B and coupling with the cable, which are formed as a single body so that the front projection and the rear projection can relatively move along the guide grooves, and mounted to the guide member.

The moving member 1231 rotates with respect to a rotary axis. The moving member has elasticity based on a spring so that the front projection can be set to be positioned by the elasticity on the top of the front guide groove. Therefore, the moving member 1231 returns to its original position by restoring force when the buckle 123 is unfastened even though it moves down in the front guide groove when the buckle 123*a* is fastened.

Here, the buckle 123*a* is provided to be inserted on the front side of the moving member. Therefore, if the buckle 123*a* is inserted in the fastening frame 123*b*, the buckle 123*a* is inserted pushing the front projection C down, and thus the front projection C moves down along the front guide groove A.

At this time, the rear projection D moving relative to the front projection C moves up along the rear guide groove B as the front projection C moves down.

Therefore, the cable coupling with the rear projection D moves upward and is thus pulled to reverse the tension of the cable acting toward the brake, thereby switching the brake over from the lock mode to the release mode.

On the other hand, if the buckle 123*a* is separated from the fastening frame 123*b*, the moving member 1231 returns to its original position by the restoring force of the spring, and the rear projection relatively moves and returns to its original position, thereby returning the direction of the tension of the cable toward the brake again and thus switching the brake over from the release mode to the lock mode.

FIGS. 19 to 21 schematically show a structure where a footrest is used as a switching member for the brake according to an embodiment of the present invention.

In this embodiment referring to FIGS. 19 to 21, the footrest serves as the brake switching member, in which the brake keeps the lock mode since the tension of the cable acts toward the brake when the footrest is folded up.

When a user sits down on the wheelchair and opens the footrest, the cable provided in the footrest is pressed to generate tension in an opposite direction and thus the tension of the cable acting toward the brake is reversed, thereby switching the brake over from the lock mode to the release mode.

FIG. 19 shows the simplest embodiment, in which so that the brake is in the lock mode since the tension of the cable is adjusted to act toward the brake when a footrest 124 is folded up, but the brake is released from the lock mode since the cable is pulled to make the tension of the cable act in an opposite direction to the brake and a brake pad is spaced apart from the brake when the footrest 124 is opened.

In more detail, two cables may be provided as the connection member 110, and a first cable (refer to a blue line) and a second cable (refer to a green line) are tensed relative to each other as the footrest is folded up and down or left and right. In the state that the footrest is folded, the first cable has no tension but only the second cable is tensed so that the brake can keep the lock mode. On the contrary, if the footrest is opened, the first cable is tensed but the second cable has no tension so that the brake can be released from the lock mode as the tension acting on the brake is changed.

FIG. 20 shows an embodiment where a footrest 125 serves as the brake switching member 120, and a tension adjuster 60 connecting with the cable is further provided in between the footrest and the brake.

The tension adjuster 60 is connected to the brake 20 by a brake cable 115, and is also connected to the footrest 125 by a control cable 116.

The tension adjuster 60 may include a guide rail 610 installed beneath the seat, and a sliding member 620 moving along the guide rail 610.

The sliding member 620 has a first end connecting with the control cable 116, and a second end connecting with the brake cable 115.

Here, the brake cable 115 is installed to be tensed in the direction of the brake and therefore the sliding member 620 is affected by the tension of the brake cable. That is, the brake cable is tensed in the direction of the brake when the footrest 125 is folded up, thereby keeping the brake in the lock mode.

On the other hand, if the footrest 125 is opened from the folded state, the length of the brake cable 115 is increased in a direction opposite to the brake, and thus tension is generated in the direction opposite to the brake, thereby pressing and pulling the control cable, moving the sliding member 620 toward the front of the wheelchair along the guide rail 610 so that the brake cable 115 can be also pulled, making the tension act in the direction opposite to the brake, and switching the brake over from the lock mode to the release mode.

Here, the tension adjuster 60 is connected to two footrests 135 by one brake cable 115, and therefore actuated only when both the footrests are all opened, thereby releasing the brake.

On the other hand, if the footrests 125 are folded up again, the increased length of the brake cable 115 is decreased to remove the tension and thus force acting on the control cable 116 is also removed to return the sliding member 620 to its original position by restoring, thereby changing the tension acting on the brake cable 115 in the direction of the brake and pressing the brake pad to switch the brake over from the release mode to the lock mode.

Here, the sliding member 620 may couple with the guide rail 610 by an elastic spring in order to provide elasticity and restoring force to move or return to an original position when the tension is applied or removed.

FIG. 21 shows an embodiment where a footrest 126 serves as the brake switching member 120, and a gear assembly 70 is further provided in between the footrest and the brake and connected by the cable.

Referring to FIG. 21, the gear assembly 70 may include a first axis rotary gear unit 710 rotated connecting with a control cable 118, a second axis rotary gear unit 720 engaged with the first axis rotary gear unit and rotating with respect to a second axis, and a brake control unit 730 coupling with a brake cable 117 and pressing the brake cable while rotating with respect to the first axis along the second axis rotary gear unit.

The first axis rotary gear unit 710 includes a cable connecting portion 711 formed at a first end with regard to the axis, connecting with first and second control cables 118*a* and 118*b* and rotating in a first axial direction; and a first gear 712 formed at a second end, engaged with the second axis rotary gear unit and transmitting rotary force to the second axis rotary gear unit. Two first axis rotary ear units 710 may form a pair to couple with the respective footrests 126.

The second axis rotary gear unit 720 includes a second gear 721 engaged with the first gear 712 and rotating in a second axial direction; and a rotary bar 722 integrated with the second gear 721 and rotating in the second axial direction.

Like the first axis rotary gear units, two second axis rotary gear units 720 may also form a pair. Two rotary bars 722 and 723 of the second axis rotary gear units 720 are actuated as the footrests 126 are opened in sequence. Therefore, the brake control unit 730 is pressed and rotated only when all the footrests 126 are opened.

In more detail, two control cables 118*a*, 118*b* respectively coupling with each footrest 126 are tensed relative to each other in accordance with whether the footrest 126 is opened or folded. The tension is applied to only the first control cable 118*a* when the footrest is folded, but only the second control cable 118*b* when the footrest is opened.

In other words, the first control cable 118*a* has the maximum length and is thus tensed in the state that the footrest is folded as shown in FIG. 21, thereby pulling the cable connecting portion 711. On the other hand, the first control cable 118*a* is decreased in length and has no tension in the state that the footrest is opened. The second control cable 118*b* has the maximum length and is thus tensed in the state that the footrest is opened, thereby pulling the cable connecting portion 711.

The cable connecting portion 711 is provided as a perpendicularly bent flange formed with through holes through which the first and second control cables 118*a* and 118*b* are connected. For example, the first control cable 118*a* is coupled to a horizontal flange, and the second control cable 118*b* is coupled to a vertical flange.

Therefore, when both the footrests are all folded up, only the first control cable 118*a* is tensed to pull the cable connecting portion 711 as shown in (a) of FIG. 21.

If one footrest is opened, only the second control cable 118*b* is tensed to pull the cable connecting portion 711 so that the vertical flange coupling with the second the control cable 118*b* can be pulled as shown in (b) of FIG. 21, thereby rotating the first axis rotary gear unit 710 in the first axial direction.

As the first axis rotary gear unit 710 rotates, the second axis rotary gear unit also rotates in the second axial direction so that the first rotary bar 722 can rotate in the second axial direction as much as displacement. At this time, the first rotary bar 722 rotates and presses the second rotary bar 723, and thus the second rotary bar 723 is rotated to the brink of pressing the brake control unit 730.

In this state, no forces are transmitted to the brake control unit 730, and therefore the brake keeps the lock mode.

Then, if the other footrest is opened, the second rotary bar 723 of the other second axis rotary gear unit is further rotated by the same operation and presses the brake control unit 730, thereby rotating the brake control unit 730 in the first axial direction.

In more detail, the brake control unit 730 is formed on a central axis, and includes a brake guide bar 731 to which a brake cable 117 is connected. If the second rotary bar 723 rotates and presses the brake guide bar 731, the central axis of the brake control unit 730 rotates in the first axial direction and the tension of pulling the brake cable 117 down is generated, thereby reversing the direction of the tension acting toward the brake, pulling the brake cable in the direction opposite to the brake, and switching the brake from the lock mode to the release mode.

In result, the brake is released from the lock mode only when two footrests are all opened.

In this state, if even one of the footrests is folded, the brake guide bar 731 of the brake control unit returns to its original position by reverse action, so that the tension of the brake cable is changed in a direction toward the brake, thereby switching the brake over from the release mode to the lock mode.

The brake according to the present invention may be variously achieved by (a) the brake pad type, (b) the caliper type generally used for a baby carriage, (c) the rim brake type generally used for a bicycle, (d) the band brake type, etc. as shown in FIG. 10. In case of a motorized brake system, the band brake type is recommended since it is easy to adjust the locking level of the brake.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

INDUSTRIAL APPLICABILITY

The present invention relates to a wheelchair brake system, and more particularly to a wheelchair brake system which is in a brake lock mode as usual as when a user stands up from a wheelchair, but automatically releases a brake only if a user sits down on the wheelchair or folds up the wheelchair, so that the wheelchair can move only when a user sits down thereon or it is folded, thereby preventing a user from getting hurt from a fall at a moment when the user sits down on and stands up from the wheelchair.

The invention claimed is:

1. A wheelchair brake system comprising:

a brake which is provided in a wheel of a wheelchair; and a brake actuation controller which connects with the brake and locks and releases the brake, wherein the brake is usually in a lock mode, but the brake actuation controller controls the brake to be switched over from the lock mode to a release mode when sensing that a load is applied to the wheelchair or the wheelchair is folded up;

wherein the brake actuation controller comprises:

a connection member which has a first end elastically connecting with the brake;

a brake switching member to which a second end of the connection member is fixed, and which actuates the connection member connecting with the brake to release the brake when the load is applied to the wheelchair, but returns the connection member to switch the brake over to the lock mode when the load is removed from the wheelchair, wherein the connection member comprises a cable or a bar;

the brake switching member is non-motorized or motorized for automatic actuation, and wherein the non-motorized brake switching member comprises:

a sensing frame which is provided beneath a seat of the wheelchair, and accommodates a second end of the cable therein to be fixed and connected thereto; and an upper plate which couples with the sensing frame and changes tension of the cable by pressing the cable accommodated in the sensing frame when the load is applied to the seat.

2. The wheelchair brake system according to claim 1, wherein the upper plate comprises a cable accommodator;

the cable accommodator does not press the cable when the load is not applied to the wheelchair, but presses the accommodated cable as the upper plate moves down when the load is applied to the wheelchair; and the brake is released since the cable is tensed in a direction opposite to the brake when the cable is pressed.

3. The wheelchair brake system according to claim 1, wherein the sensing frame and the upper plate are divided into a plurality of units;

at least one of cables connected to the respective units is connected to the brake; and the brake is switched over from the lock mode to the release mode when at least one among the plurality of units is actuated.

4. A wheelchair brake system comprising:

a brake which is provided in a wheel of a wheelchair; and a brake actuation controller which connects with the brake and locks and releases the brake, wherein the brake is usually in a lock mode, but the brake actuation controller controls the brake to be switched over from the lock mode to a release mode when sensing that a load is applied to the wheelchair or the wheelchair is folded up;

wherein the brake actuation controller comprises:

a connection member which has a first end elastically connecting with the brake;

a brake switching member to which a second end of the connection member is fixed, and which actuates the connection member connecting with the brake to release the brake when the load is applied to the wheelchair, but returns the connection member to switch the brake over to the lock mode when the load is removed from the wheelchair, wherein the connection member comprises a cable or a bar;

the brake switching member is non-motorized or motorized for automatic actuation, and wherein the motorized brake switching member comprises:

a sensing frame which is provided beneath a seat of the wheelchair, accommodates a second end of the cable therein to be fixed and connected thereto, and comprises an electric driver to electrically wind the cable to change tension; and an upper plate which couples with the sensing frame and comprises a sensor to sense whether the load is applied to the seat.

5. The wheelchair brake system according to claim 4, wherein the electric driver comprises: an electric pulley for changing a winding direction of a cable, and winding the cable; a motor for providing torque to drive the electric pulley; and a driving controller for controlling the torque of the motor, and the electric driver drives the motor to rotate the electric pulley to make tension act in an opposite direction of the brake and release the brake when a pressure sensor provided in the upper plate senses the load applied to the wheelchair, but drives the motor to rotate in an opposite direction to rotate and return the electric pulley to its original position, to make the tension act toward the brake and to lock the brake when the load is removed from the wheelchair.

6. The wheelchair brake system according to claim 5, wherein the electric driver further comprises a sensor unit such as an acceleration sensor and a tilt sensor, and the sensor unit is provided to make the brake be not only simply switched over between the lock mode and the release mode, but also automatically actuated for safety when the wheelchair moves at an excessively high speed or on a slope.

7. A wheelchair brake system comprising:

a brake which is provided in a wheel of a wheelchair; and a brake actuation controller which connects with the brake and locks and releases the brake, wherein the brake is usually in a lock mode, but the brake actuation controller controls the brake to be switched over from the lock mode to a release mode when sensing that a load is applied to the wheelchair and a safety device is operated.

8. The wheelchair brake system according to claim 7, wherein the brake actuation controller comprises:

a connection member which has a first end connecting with the brake;

a brake switching member which couples with a second end of the connection member, actuates the connection member connecting with the brake to release the brake only when the load is applied to the wheelchair and the safety device is operated, but returns the connection member to switch the brake over to the lock mode again when the safety device is not operated.

9. The wheelchair brake system according to claim 8, wherein the safety device comprises one selected along a safety bar, a seat belt and a footrest.

10. The wheelchair brake system according to claim 9, wherein, when the safety device is the safety bar or the seat belt, the safety bar or the seat belt serves as the brake switching member, and the brake keeps the lock mode since the tension of the cable acts toward the brake before the safety bar or the seat belt is fastened;

the cable provided inside the safety bar is pressed and tensed in a direction opposite to the cable to change the tension of the cable from a direction of the brake to an opposite direction so that the brake can be switched over from the lock mode to the release mode when the load is applied to the wheelchair and the safety bar or the seat belt is fastened; and the tension acting on the cable inside the safety bar is removed and the tension of the cable acts toward the brake again so that the brake can be switched over from the release mode to the lock mode when the safety bar or the seat belt is unfastened.

11. The wheelchair brake system according to claim 10, wherein when the safety device is the seat belt, the seat belt is achieved by a buckle, in which the cable connecting with the brake is positioned inside a fastening frame, i.e. a buckle inlet to which a buckle 122 is fastened, the cable is pressed when the buckle 122 is coupled to the buckle inlet of the fastening frame in order to fasten the seat belt, and the tension acting toward the brake is reversed to release the brake from the lock mode as the cable is pressed.

12. The wheelchair brake system according to claim 11, wherein the fastening frame comprises a guide member therein to change tension of a cable, and the guide member displaces the cable and generates pulling force, and thus tension of the cable is reversed so that the brake can be switched over from the lock mode to the release mode as the buckle is inserted in and fastened to the fastening frame.

13. The wheelchair brake system according to claim 12, wherein the guide member comprises two opposite guide grooves (A, B) respectively formed in front and rear sides thereof, and a moving member comprising a front projection C protruding above from the front guide groove A and a rear projection D protruding below from the rear guide groove B and coupling with the cable, which are formed as a single body so that the front projection and the rear projection can relatively move along the guide grooves, and mounted to the guide member.

14. The wheelchair brake system according to claim 13, wherein the moving member rotates with respect to a rotary axis, and the moving member has elasticity based on a spring so that the front projection can be set to be positioned by the elasticity on the top of the front guide groove, thereby returning the moving member to its original position by restoring force when the buckle is unfastened in a state that the front projection moves down in the front guide groove when the buckle is fastened;

the buckle is provided to be inserted on the front side of the moving member, and when the buckle is inserted in the fastening frame, the buckle is inserted pushing the front projection C down, and thus the front projection C moves down along the front guide groove A;

the rear projection D moving relative to the front projection C moves up along the rear guide groove B as the front projection C moves down, so that the cable coupling with the rear projection D can move upward and is thus pulled to reverse the tension of the cable acting toward the brake and switch the brake over from the lock mode to the release mode;

when the buckle is separated from the fastening frame, the moving member returns to its original position by the restoring force of the spring, and the rear projection relatively moves and returns to its original position, thereby returning the direction of the tension of the cable toward the brake again and thus switching the brake over from the release mode to the lock mode.

15. The wheelchair brake system according to claim 9, wherein, when the safety device is a footrest, the footrest serves as the brake switching member, and the brake keeps the lock mode since the tension of the cable acts toward the brake when the footrest is folded; and the brake is switched over from the lock mode to the release mode when the load is applied to the wheelchair and the footrest is opened since the cable provided in the footrest is pressed and tensed in a direction opposite to the cable and the tension of the cable is changed in the opposite direction to the brake.

16. The wheelchair brake system according to claim 9, wherein, when the safety device is a footrest, the footrest serves as the brake switching member, and a tension adjuster is further provided in between the footrest and the brake and connecting with the cable;

the tension adjuster connects with the brake through the brake cable, and the footrest through the control cable; and the tension adjuster comprises a guide rail fixed beneath the seat, and a sliding member moving along the guide rail and having a first end connecting with the control cable and a second end connecting with the brake cable.

17. The wheelchair brake system according to claim 16, wherein the brake cable is tensed in a direction toward the brake so that the brake can keep the lock mode when the footrest is folded, the brake cable is increased in length and tensed in a direction opposite to the brake so that the control cable can be pressed and pulled when the footrest is opened, and the brake is switched over from the lock mode to the release mode as the sliding member moves along the guide rail in a frontward direction of the wheelchair and thus the brake cable is also pulled and the direction of the tension acting toward the brake is changed into the direction opposite to the brake.

18. The wheelchair brake system according to claim 9, wherein, when the safety device is a footrest, the footrest serves as the brake switching member, and a gear assembly is further provided in between the footrest and the brake and connecting with the cable; and the gear assembly comprises a first axis rotary gear unit rotated connecting with a control cable, a second axis rotary gear unit engaged with the first axis rotary gear unit and rotating with respect to a second axis, and a brake control unit coupling with a brake cable and pressing the brake cable while rotating with respect to the first axis along the second axis rotary gear unit.

19. The wheelchair brake system according to claim 18, wherein the first axis rotary gear unit comprises a cable connecting portion formed at a first end with regard to an axis, connecting with first and second control cables and rotating in a first axial direction; and a first gear formed at a second end, engaged with the second axis rotary gear unit and transmitting rotary force to the second axis rotary gear unit, in which two first axis rotary ear units form a pair to couple with the respective footrests;

the second axis rotary gear unit comprises a second gear engaged with the first gear and rotating in a second axial direction; and a rotary bar integrated with the second gear and rotating in the second axial direction, in which two second axis rotary gear units form a pair like the first axis rotary gear unit; and two rotary bars of the second axis rotary gear units are actuated as the footrests are opened in sequence, so that the brake control unit can be pressed and rotated only when all the footrests are opened.

* * * * *